US012714177B1

(12) United States Patent
Conzaman et al.

(10) Patent No.: US 12,714,177 B1
(45) Date of Patent: Aug. 25, 2026

(54) SURF AND WATER SPORTS HELMET

(71) Applicant: KNOCK PROTECTIVES, LLC, Santa Cruz, CA (US)

(72) Inventors: Grant James Conzaman, Santa Cruz, CA (US); Koa Smith, Santa Cruz, CA (US); Gregg Thomas Jacobsen, Santa Cruz, CA (US); Julio Sezar Valencia, Santa Cruz, CA (US)

( * ) Notice: Subject to any disclaimer, the term of this patent is extended or adjusted under 35 U.S.C. 154(b) by 0 days.

(21) Appl. No.: 19/312,294

(22) Filed: Aug. 27, 2025

(51) Int. Cl.
*A42B 3/28* (2006.01)
*A63B 33/00* (2006.01)

(52) U.S. Cl.
CPC ..... *A42B 3/281* (2013.01); *A42B 3/28* (2013.01); *A42B 3/283* (2013.01); *A63B 33/00* (2013.01)

(58) Field of Classification Search
CPC ..... A42B 3/281; A42B 3/28; A42B 3/283; A63B 33/00
See application file for complete search history.

(56) References Cited

U.S. PATENT DOCUMENTS

| | | | | |
|---|---|---|---|---|
| 3,274,612 A * | 9/1966 | Merriam | A42B 3/00 2/421 |
| 4,134,155 A * | 1/1979 | Robertson | A63B 71/10 2/412 |
| 11,730,222 B2 * | 8/2023 | Vito | A42B 3/062 2/414 |
| 2023/0180880 A1 * | 6/2023 | Melofchik | A42B 3/283 2/411 |
| 2024/0399212 A1 * | 12/2024 | Norvell | A42B 3/16 |

* cited by examiner

*Primary Examiner* — Khaled Annis
(74) *Attorney, Agent, or Firm* — Patrick T. Reilly

(57) ABSTRACT

Water sport headwear that is shaped to protect a wearer's head while also reducing the occurrence of water flowing into the wearer's eyes when emerging from water or after passing through a wave. The headwear includes a plurality of openings that permit water to exit through water and air headwear as the wearer emerges from water. The headwear provides openings and internal channels that encourage water to leave the helmet and reducing the occurrence of an outflow pathway of water from the helmet and toward or over either of the wearer's eyes.

21 Claims, 24 Drawing Sheets

SURF AND WATER SPORTS HELMET

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION BY REFERENCE

The present disclosure incorporates by reference the following publications, patents, and/or patent applications, in their entirety and for all purposes: US Patent Application Publication No.: US 2024/0399212 A1 titled PROTECTIVE WATER HEADWEAR (Inventor NORVELL et al.) and published on Dec. 5, 2024; and U.S. Pat. No. 3,274,612 titled HELMET FOR WATER SPORTS (Inventor Merriam, R.C.) and issued on Sep. 27, 1966. The above-cited publications, patents, and/or patent applications are incorporated herein by reference in their entirety and for all purposes. All publications, patents, and/or patent applications mentioned in this specification are herein incorporated by reference to the same extent as if each individual publication, patent, or patent application was specifically and individually indicated to be incorporated by reference.

STATEMENT REGARDING PRIOR DISCLOSURES BY THE INVENTOR OR A JOINT INVENTOR

Not Applicable.

BACKGROUND OF THE INVENTION

Field of the Invention

The present invention is related generally to protective helmets useful in water sports, and more particularly to protective headgear that is preferable in instances where a wearer's head emerges from water is particularly common.

Description of Related Art Including Information Disclosed Under 37 CFR 1.97 and 1.98

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

Individuals engaged in open water activities or water sports are exposed to the hydraulic dynamics of the body water in which they are operating. Effective protective headwear for such activities and sports preferably allows for reducing the incidence of injury in view of the foreseeable forces that the water directs toward the helmet wearer's body. Purely designed headwear can prevent a wearer's head from safely and/or easily exiting through the surface of the water due the physics of such movement, to include emerging from a wave submersion. There is a long-felt need to provide headgear that more optimally permits drainage of water and a more reliable release of air when a wearer moving from a fully or partially submerge position and into a less submerged position. In addition, there is a long-felt need to provide headgear that limits drainage of water over the wearer's eyes when the headgear wearer is moving from a fully or partially submerge position and into a less submerged position.

BRIEF SUMMARY OF THE INVENTION

Towards these and other objects of the method of the present invention (hereinafter, "the invented method") that are made obvious to one of ordinary skill in the art in light of the present disclosure, what is provided is a headwear that both protects a wearer's head and better channels on outflow of water from the helmet over either of a wearer's eyes when a wearer moving from a more submerged position to a less submerged position, to include passing through wave action.

The invented method prioritizes low water absorption by the present invention, corrosion resistance of the present invention, and enhanced flexibility of elements and components of the present invention, which are all especially critical aspect of the helmets, including headgear, in marine environments.

A first preferred embodiment of the present invention (or "the first surf helmet") comprises an outer shell (or simply, "the shell:) forming a plurality of shell vents and ports, and an inner liner positioned within the outer shell. The shell may be or comprise ABS a unitary Acrylonitrile Butadiene Styrene ("ABS") thermoplastic, fiberglass and/or carbon fiber or other suitable materials known in the art. The inner liner (or simply, "the liner") may be or comprise Expanded Polypropylene ("EPP") material, expanded polystyrene ("EPS") foam, and/or other suitable materials known in the art.

A padding assembly includes elements that are are adhered to or otherwise attached or coupled directly indirectly to the shell and/or the liner by suitable means known in the art. The padding assembly may be or comprise Vinyl Nitrile, urethane foam, EPS foam, expanded polystyrene (EPS) foam, EPP foam and/or other suitable materials known in the art.

The headgear liner, or simply "liner", forms a plurality of interior channels wherein each interior channel extends away from at least one shell port. The liner further defines a plurality of dedicated core openings, each dedicated core opening enabling egress from one shell vent or port, whereby water is enabled to transit from inside the first surf helmet and beyond the outer shell exterior surface. The first surf helmet may optionally include at least two superior elongate water vents ("superior water vents") extending fully through the outer shell and laterally both over a superior section of the outer shell and across a length axis of the first surf helmet, wherein the length axis extends from a posterior side of the first surf helmet to an anterior side of the first surf helmet.

The liner may include a unified expanded polypropylene foam core comprising molded-in keyhole snap-baskets. Additional elements of a retention system in accordance with the invented method may include straps, anchors, double-headed mushroom pin connectors, and other fasteners.

The first surf helmet may further optionally provide (a.) one or more right side elongate water ports, (b.) one or more left side elongate water ports (c.) the liner having an anterior section extending to a front inner rim of the outer shell and positioned onto the interior surface of an outer shell anterior section, wherein the first surf helmet at least partially inhibits water flow from within the first surf helmet to over a user's face when the surf helmet is worn, (d.) a bottom edge of the first surf helmet, the bottom edge positioned distally from the superior section of the first surf helmet, wherein the one or more channels directs water flow and/or air flow from within the first surf helmet and away from a user's eyes when the user's head has emerged from a submersion in water and the superior section is positioned above the bottom edge of the first surf helmet; (e.) at least one longitudinal channel that directs water toward the posterior side of the first surf helmet from at least one interior channel and into a second interior channel of a plurality of interior channels; (f.) at least one longitudinal channel that directs water from a first interior channel of the plurality of interior channels and out of at least one shell port of the plurality of shell ports (g.) a comfort liner disposed on an liner interior side, wherein the comfort liner is positioned distally from the outer shell and the comfort liner allows unobstructed function of the plurality of interior channels, and the comfort liner enhances user comfort and moisture management; (h.) the outer shell further comprising at least one right posterior elongate water port, the at least one right posterior elongate water port extending downwards and toward a bottom edge of the first surf helmet; (i.) the inner structural core comprising an additional matching right posterior core opening, whereby the at least one right posterior elongate water port and the additional matching right posterior core opening in combination enable water to pass through the outer shell; (j.) a plurality of interior channels further comprising a right posterior channel that extends from an additional matching right posterior core opening to a bottom of the helmet; (k.) the outer shell further comprising at least one left posterior elongate water port, the at least one left posterior elongate water port extending downwards and toward a bottom edge of the first surf helmet; (l.) the liner further comprising an additional matching left posterior core opening, whereby the at least one left posterior elongate water port and the additional matching left posterior core opening in combination enable water to pass through the outer shell; (m.) a left posterior channel that extends from the additional matching left posterior core opening to a bottom of the helmet; (n.) an liner having a plurality of core parts, each core part formed prior to installation onto the interior surface of the outer shell.

A second preferred embodiment of the present invention (or "the second surf helmet") having an outer shell forming a plurality of superior water ports extending laterally over the superior section of the outer shell and across a length axis of the second surf helmet; a plurality elongate water ports, each elongate water port extending downwards from the superior section toward a bottom of the second surf helmet; and an liner forming individual channels, each channel leading from a water port and towards the bottom of the second surf helmet.

A third preferred embodiment of the present invention (or "the third surf helmet") an outer shell, and at least two superior elongate water ports ("superior water ports") extending laterally over a portion of superior section of the outer shell and downwards from a length axis of the surf helmet upper edges below the length axis, wherein the length axis extending from a posterior side of the surf helmet to an anterior side of the surf helmet; an liner extending downward from at least two superior elongate water ports, and the liner forming a right channel extending from a right end of at least one superior water port and toward a bottom of the surf helmet, and the liner forming a left channel extending from a left end of at least one superior water port and toward the bottom of the surf helmet.

The third surf helmet may optionally further form a frontal extension that is contoured to channel water laterally into the integrated channel and vent system to further improve fluid evacuation and user visibility. Th liner further optionally presents an liner anterior section extending to a front inner rim of the outer shell and positioned onto the interior surface of an outer shell anterior section, wherein the third surf helmet at least partially inhibits water flow from within the surf helmet to over a user's face when the third surf helmet is worn.

The liner of the third surf helmet optionally further forms a recessed channel located behind a brow region of the structural core, the recessed channel configured to capture and redirect water away from the wearer's face during eviting a submersion or passing through wave impact, thereby enhancing visibility and user comfort. The third structural core may optionally extend beyond a standard protective test line defined by whitewater helmet safety standards, thereby providing enhanced cranial coverage during impact.

A fourth alternate preferred embodiment of the present invention (or "the fourth surf helmet") provides a user's cranial retention system. The retention system may include a first strap anchored to an outer helmet shell at a first strap end and a second strap pinned end having a first attachment element, the first attachment presenting a first mushroom pin and a second mushroom pin having a larger head than a smaller head of the first mushroom pin, wherein the first mushroom pin is more distal than the second mushroom pin from the first strap end, and a key-hole snap basket coupled with the outer shell and presenting a key-hole slot, the key-hole slot having a first aperture sized to accept an insertion of the second mushroom pin head, and a smaller second aperture sized to inhibit a withdrawal of the second mushroom pin head. The retention system may additionally comprise at least one laterally positioned adjustable chip strap assembly extending downwards from the outer shell, and/or a rear fit adjustment system.

In certain still alternate embodiments of the present invention, inventive elements of the retention system include one or more key-hole snap baskets that are semi-rigid, and optionally molded directly into the liner at separate anchor locations. Double-headed mushroom pin connectors on on separate retention strap ends and a hangar of the retention system insert into the key-hole snap baskets, thereby creating a secure connection. When coupled with two or more key-hole snap baskets, the retention straps form a rear yoke that distributes retention forces, with a chin strap providing user adjustability, An optional rear fit system is further included in certain even alternate embodiments of the present invention.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Turning now generally to the figures, where like labels represent like elements throughout the drawings, various aspects, features and embodiments of a surf and water sports helmet still will be presented in more detail. The examples as set forth in the drawings and detailed description are provided by way of explanation and are not meant as limitations on the scope of a surf and water sports helmet. A surf and water sports helmet still according to an embodiment of the invention thus includes any modifications and variations of the following examples as come within the scope of the appended claims and their equivalents.

BRIEF DESCRIPTION OF THE SEVERAL VIEWS OF THE DRAWING(S)

The detailed description of some embodiments of the invention is made below with reference to the accompanying figures, wherein like numerals represent corresponding elements and parts of the figures.

Figure 1:
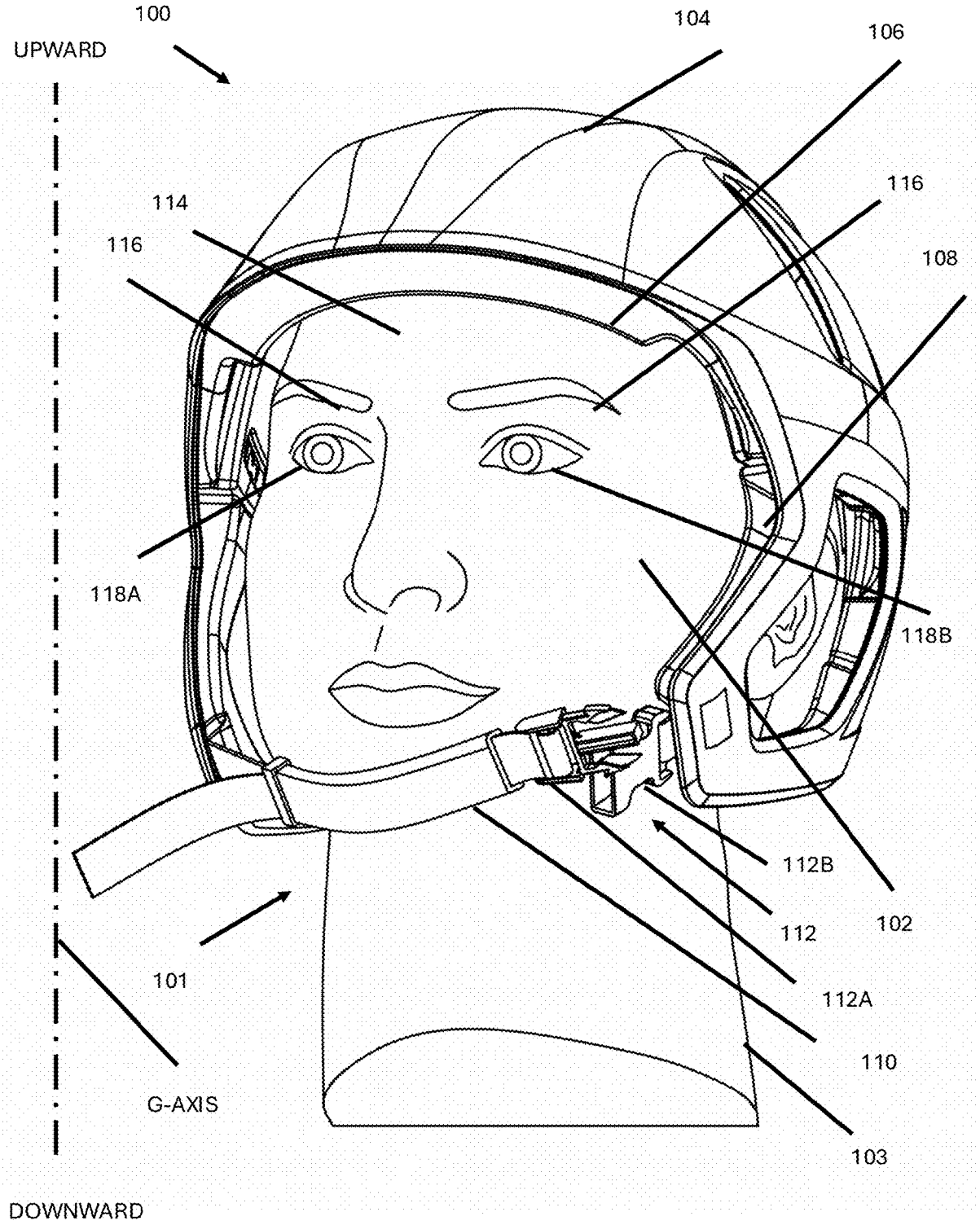
FIG. 1 is a front external view of a user wearing a first preferred embodiment of the present invention ("the headgear")
Figure 5:
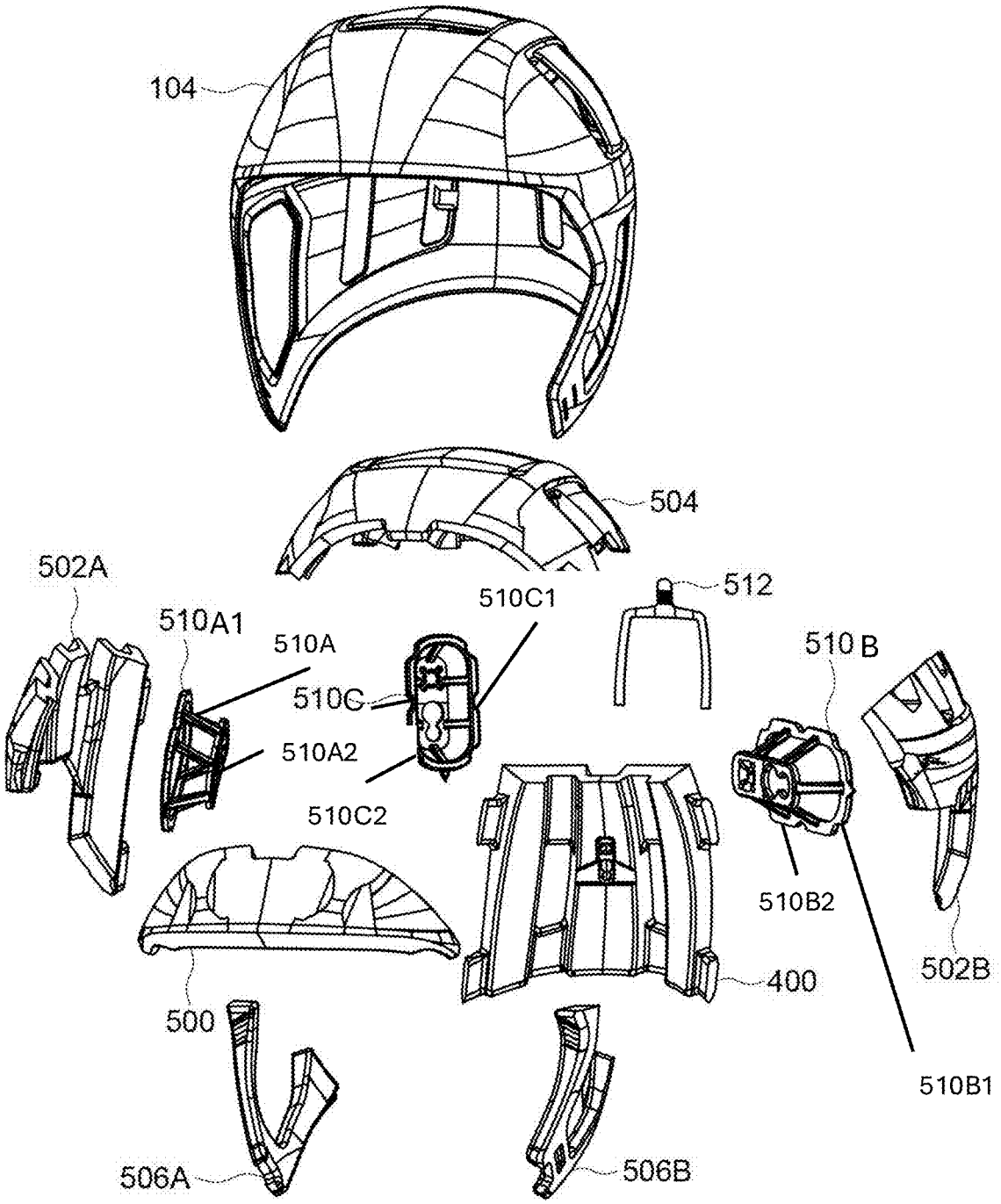
FIG. 5 is an exploded view of a plurality of components of the liner of the headgear of FIG. 1.
Figure 11:
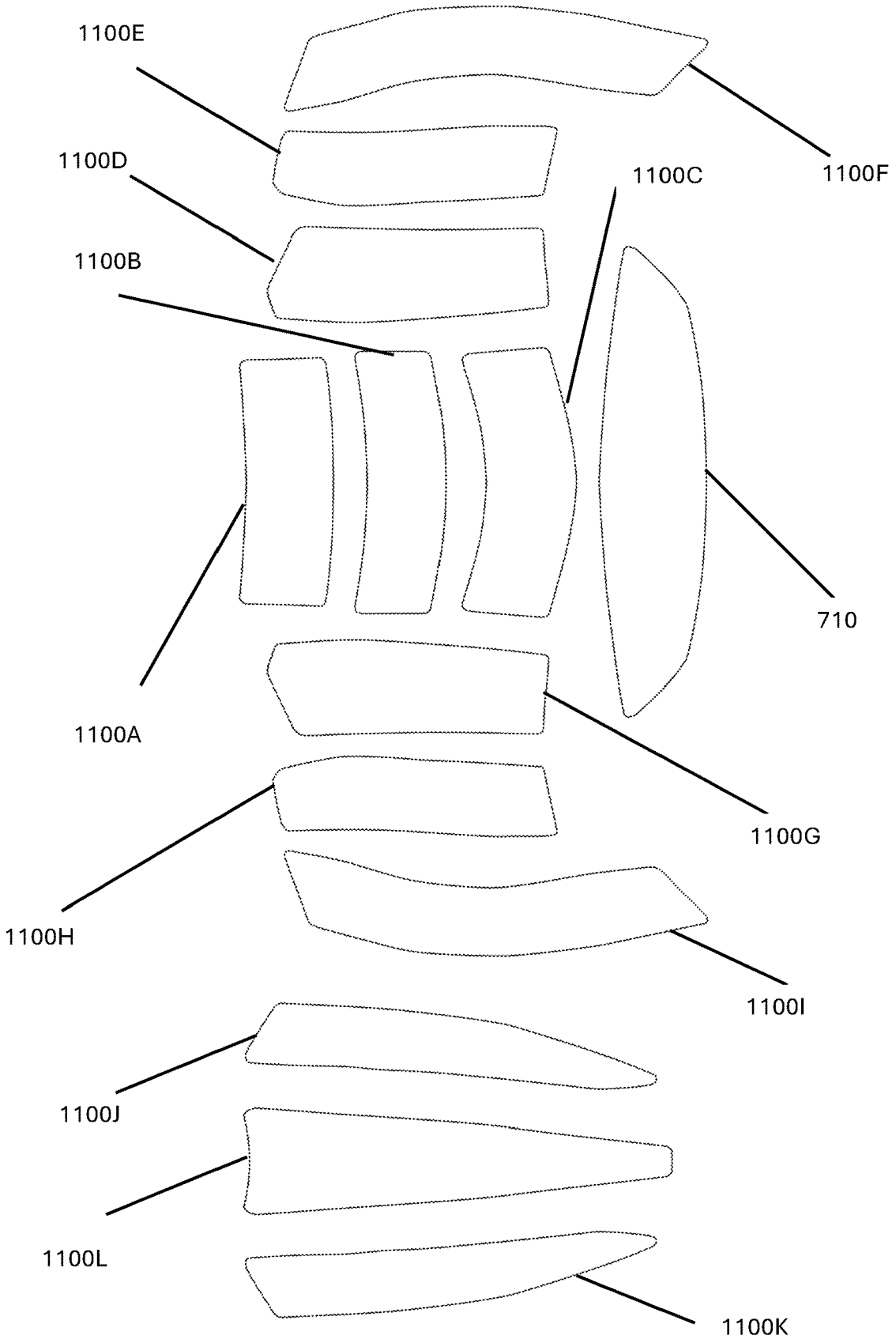
Figure 12:
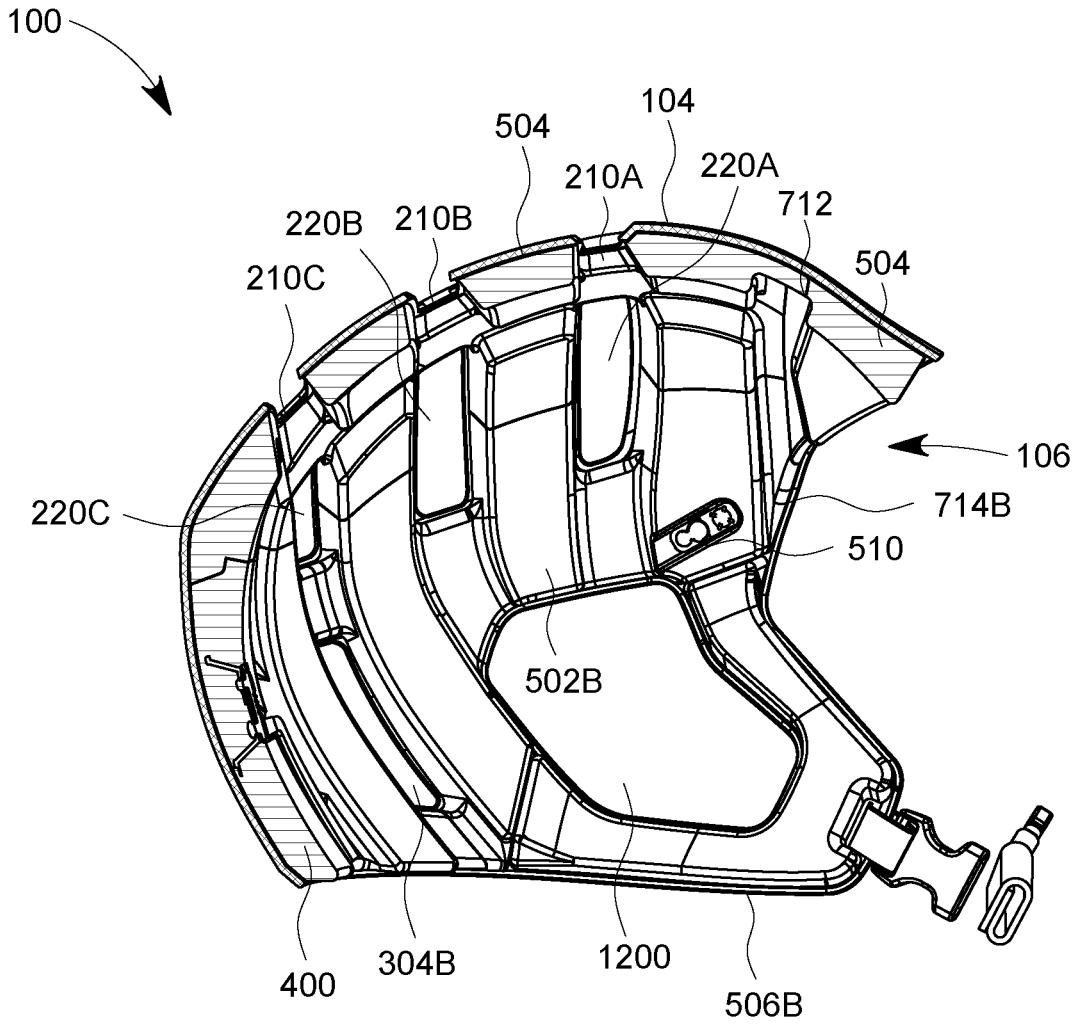
Figure 13:
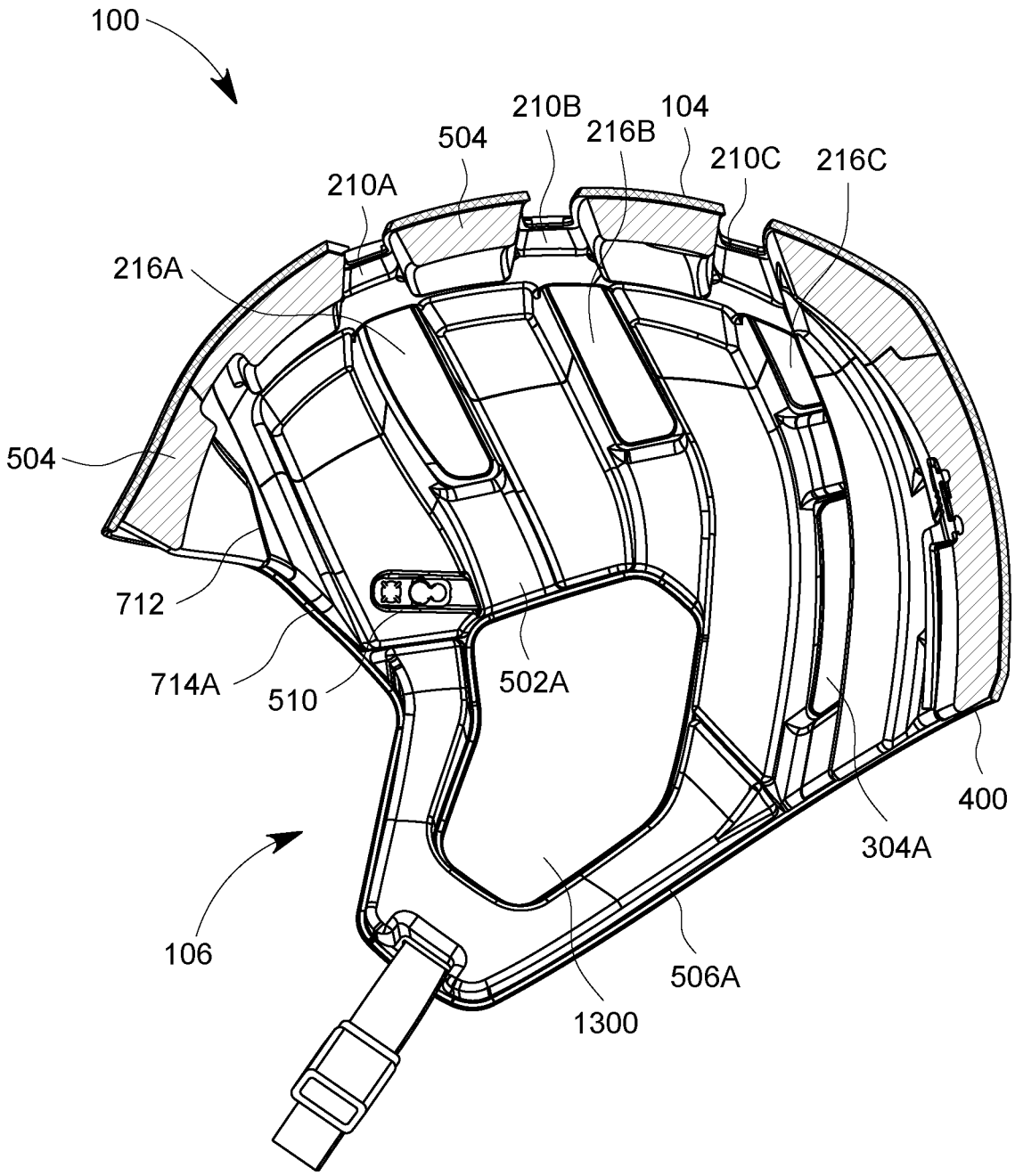
Figure 14:
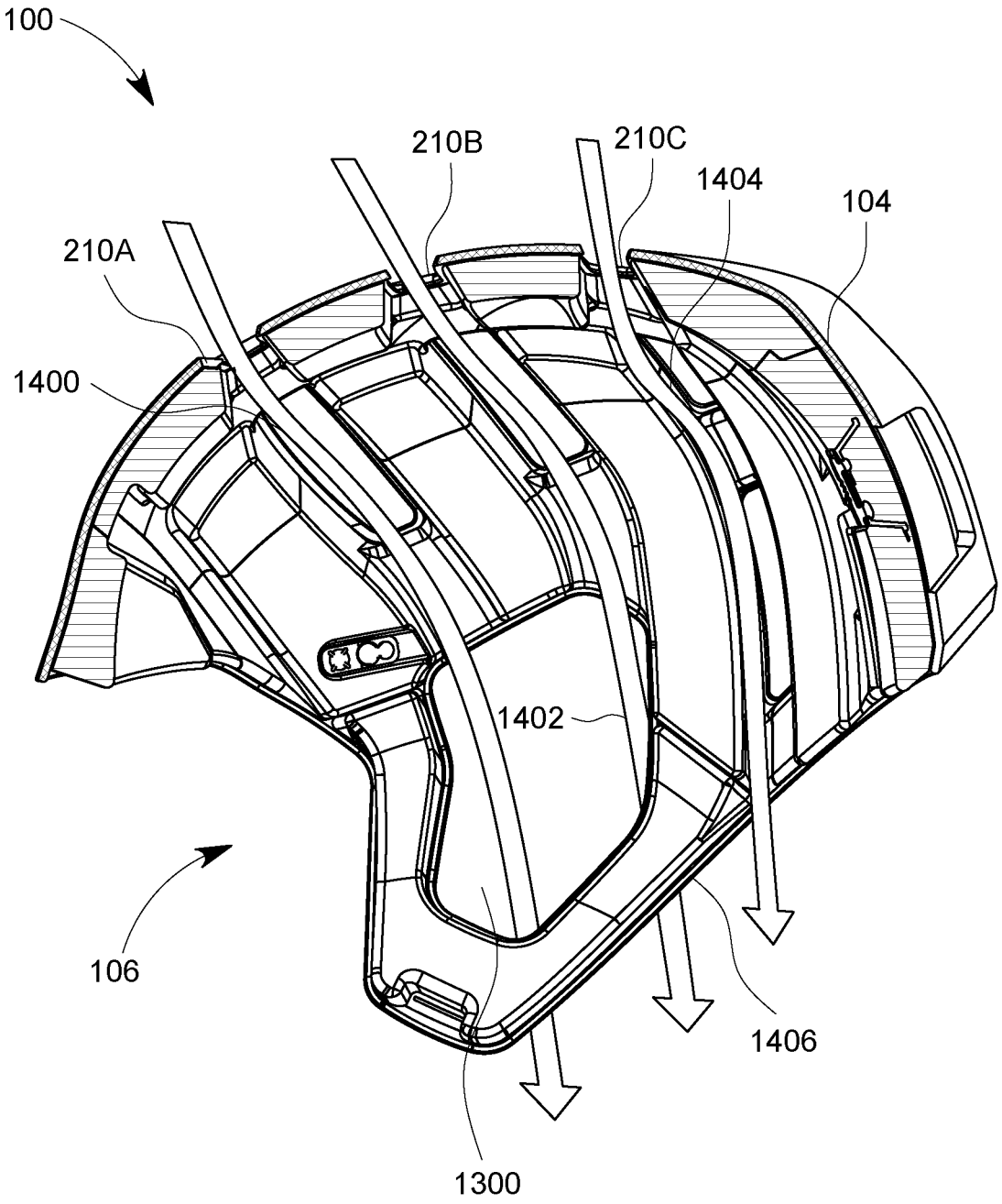
Figure 15:
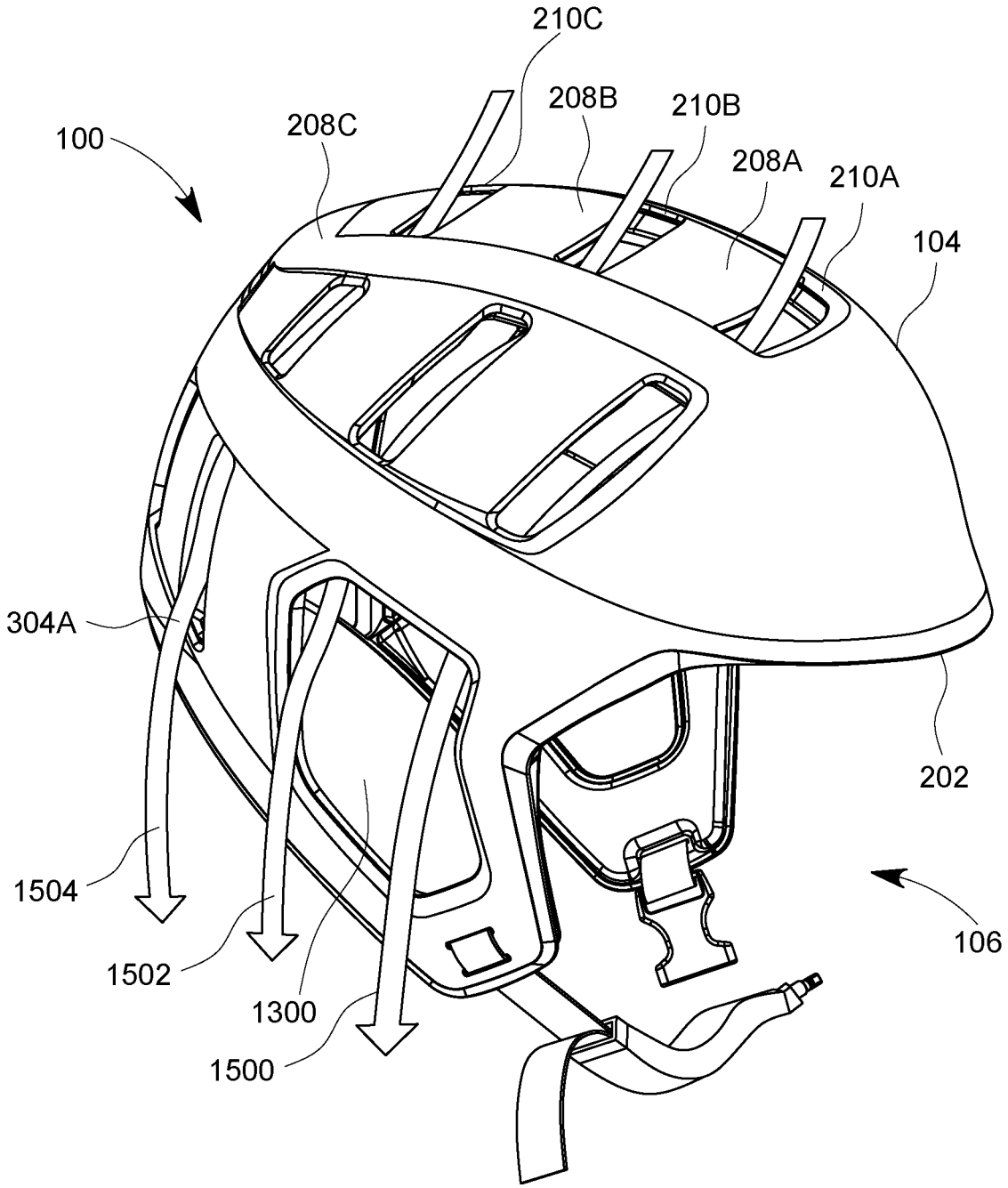
Figure 16:
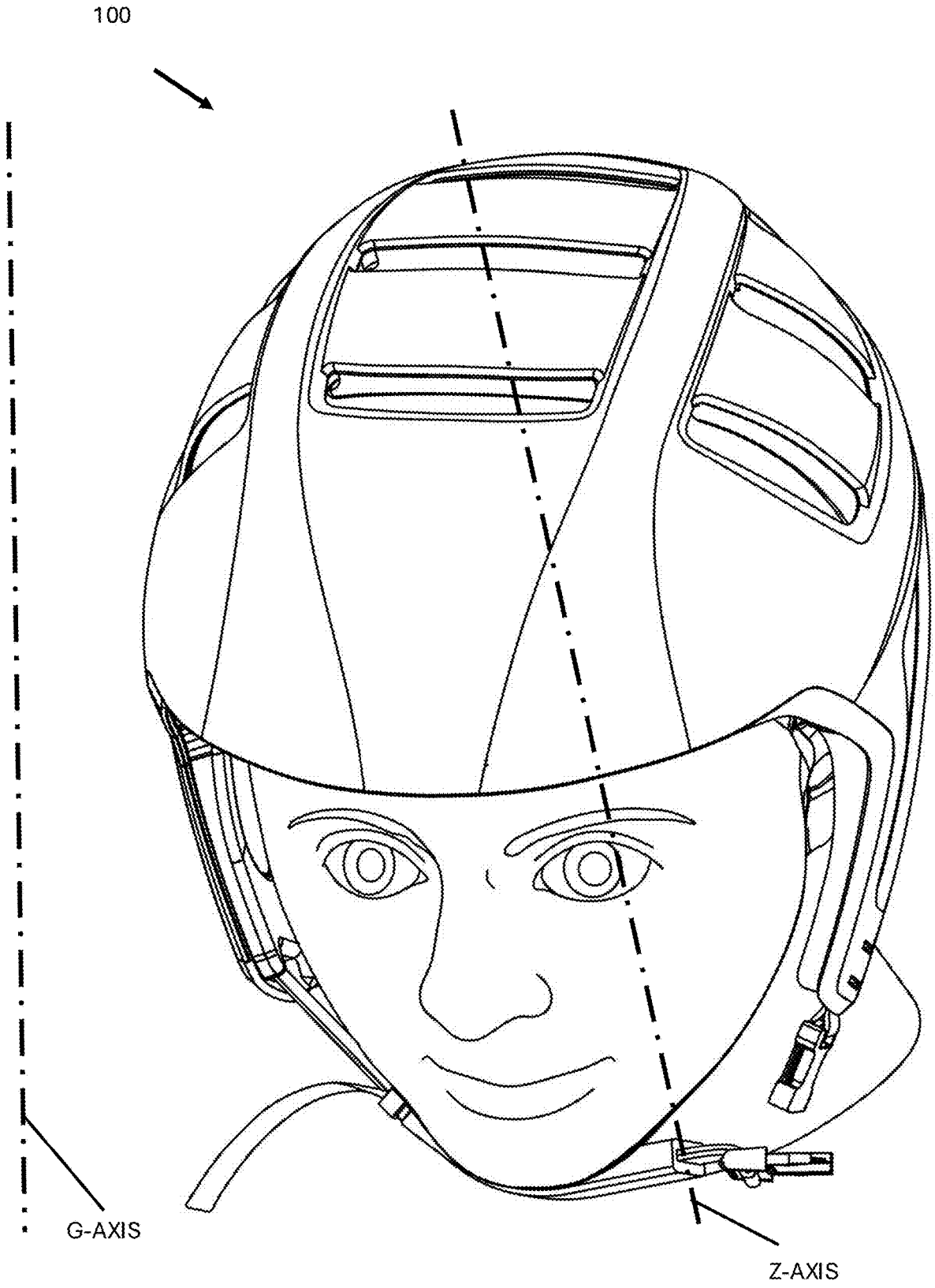
Figure 17:
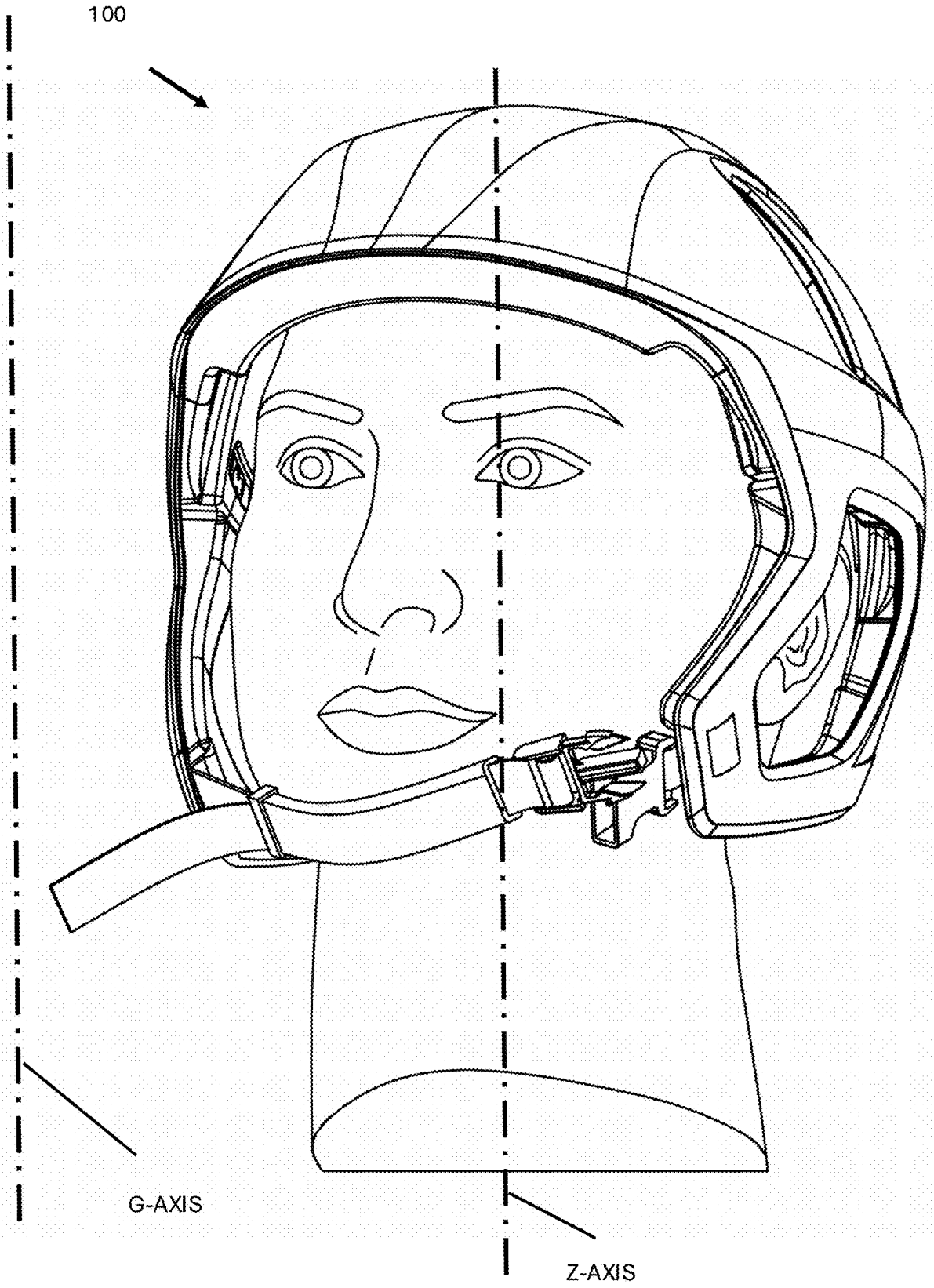
Figure 18:
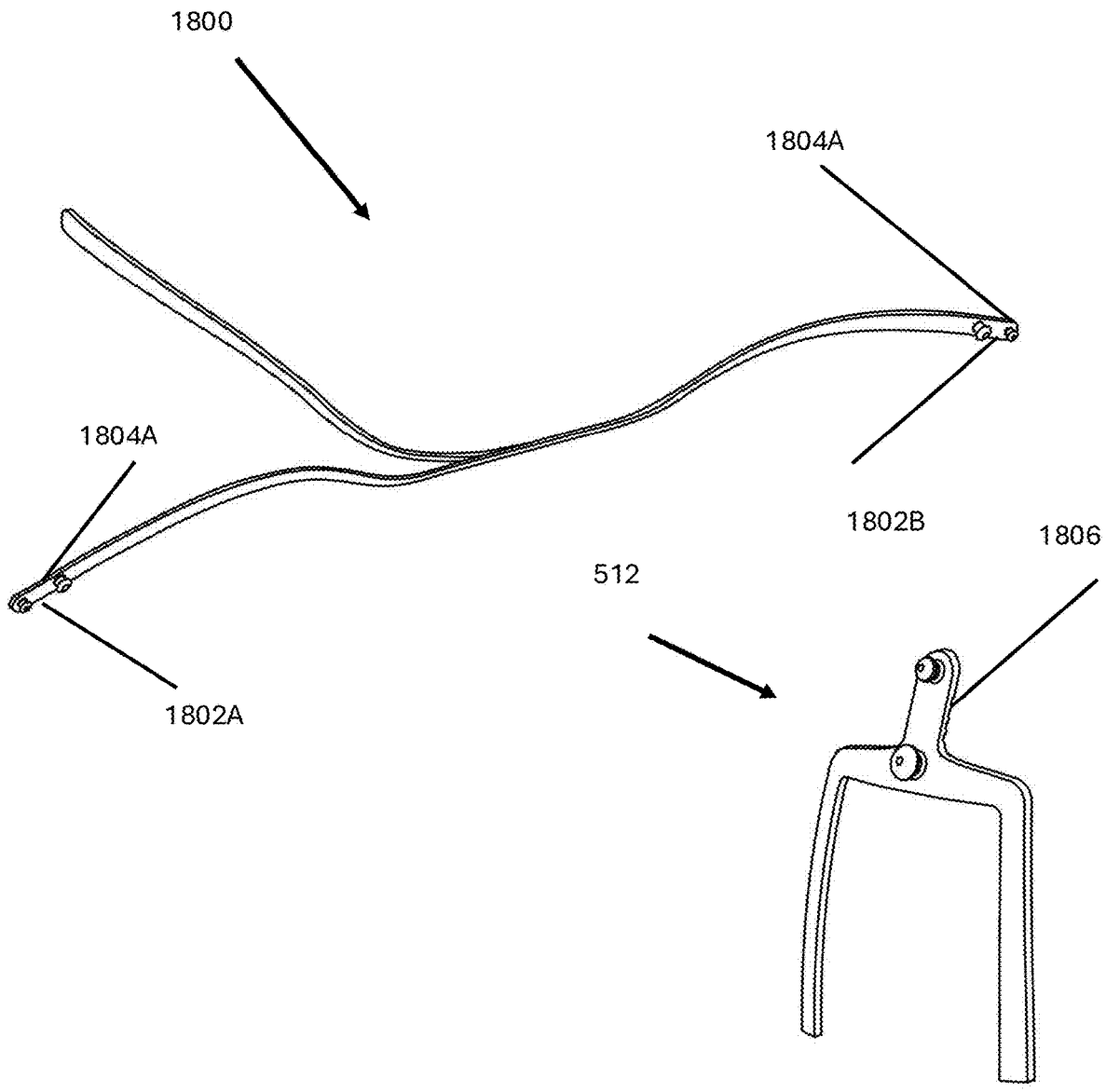
Figure 19:
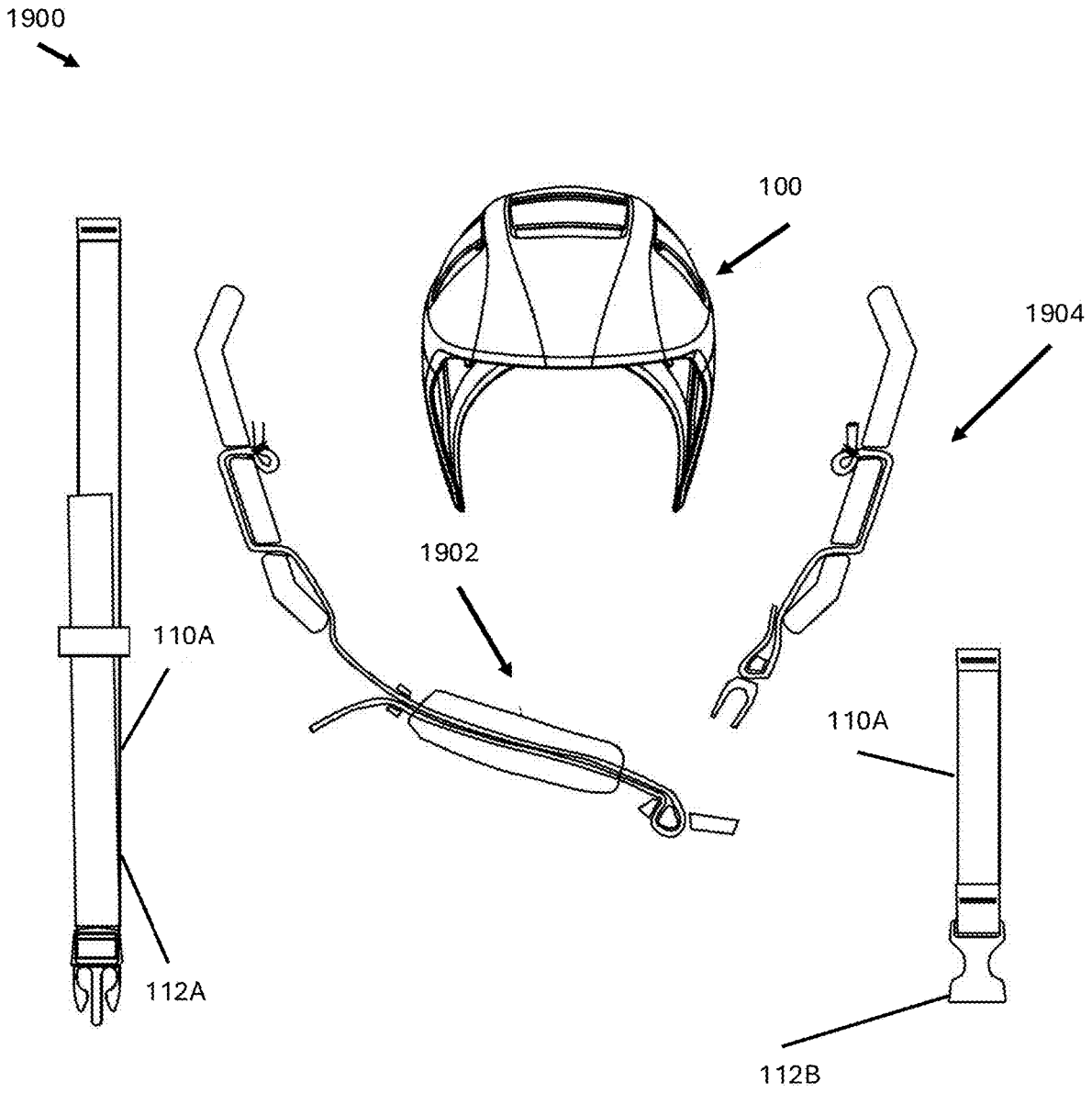
Figure 20:
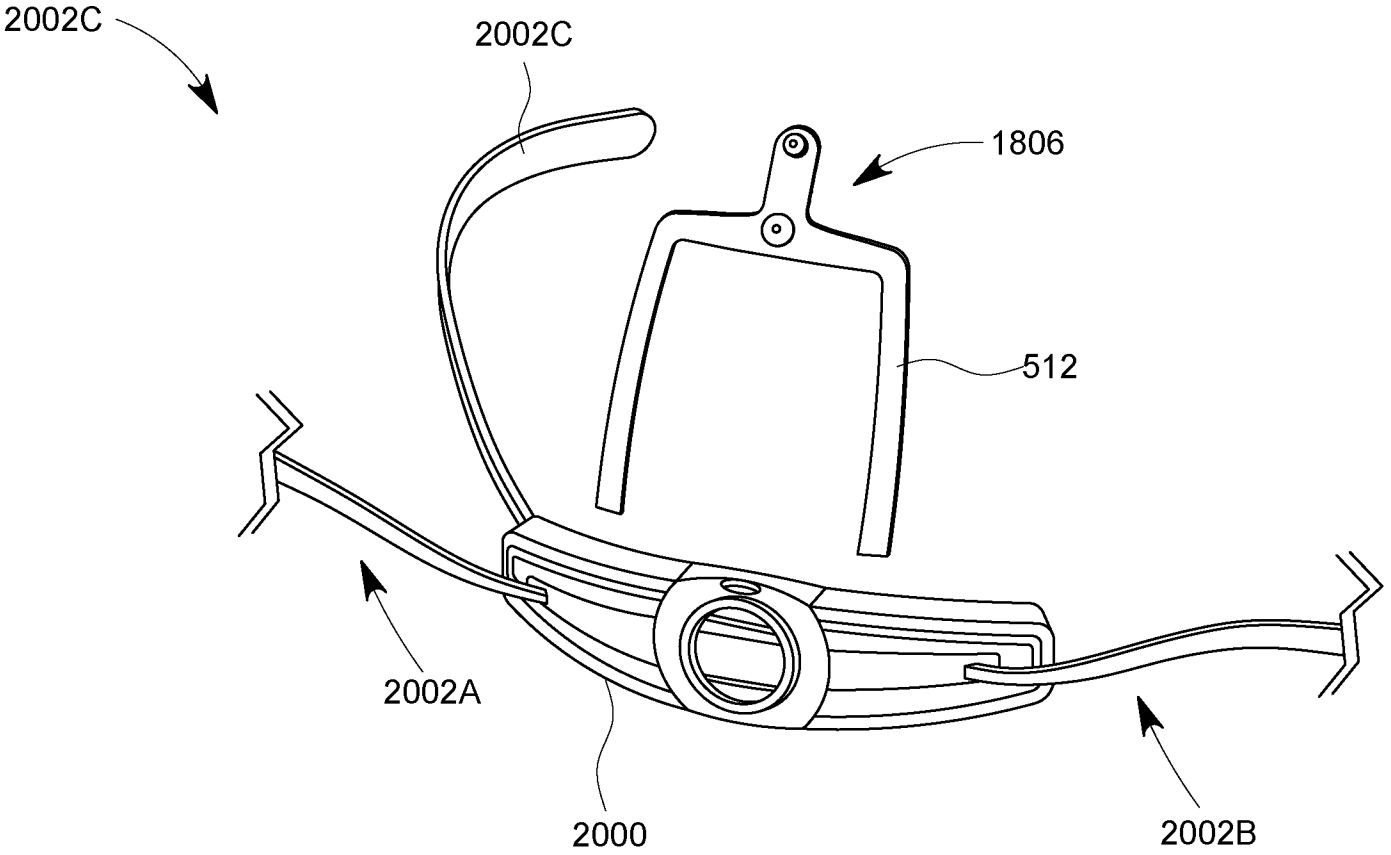
Figure 21:
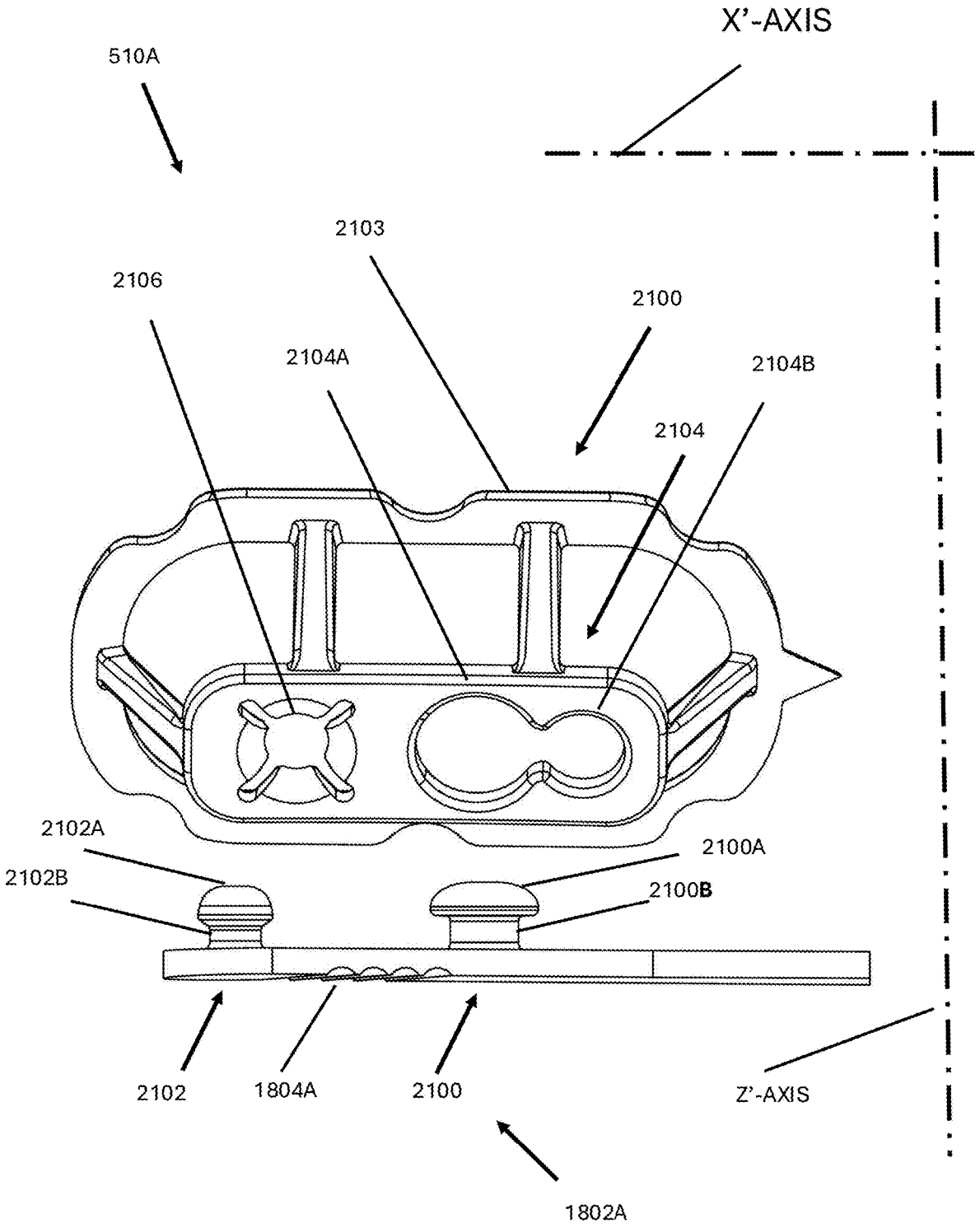
Figure 22:
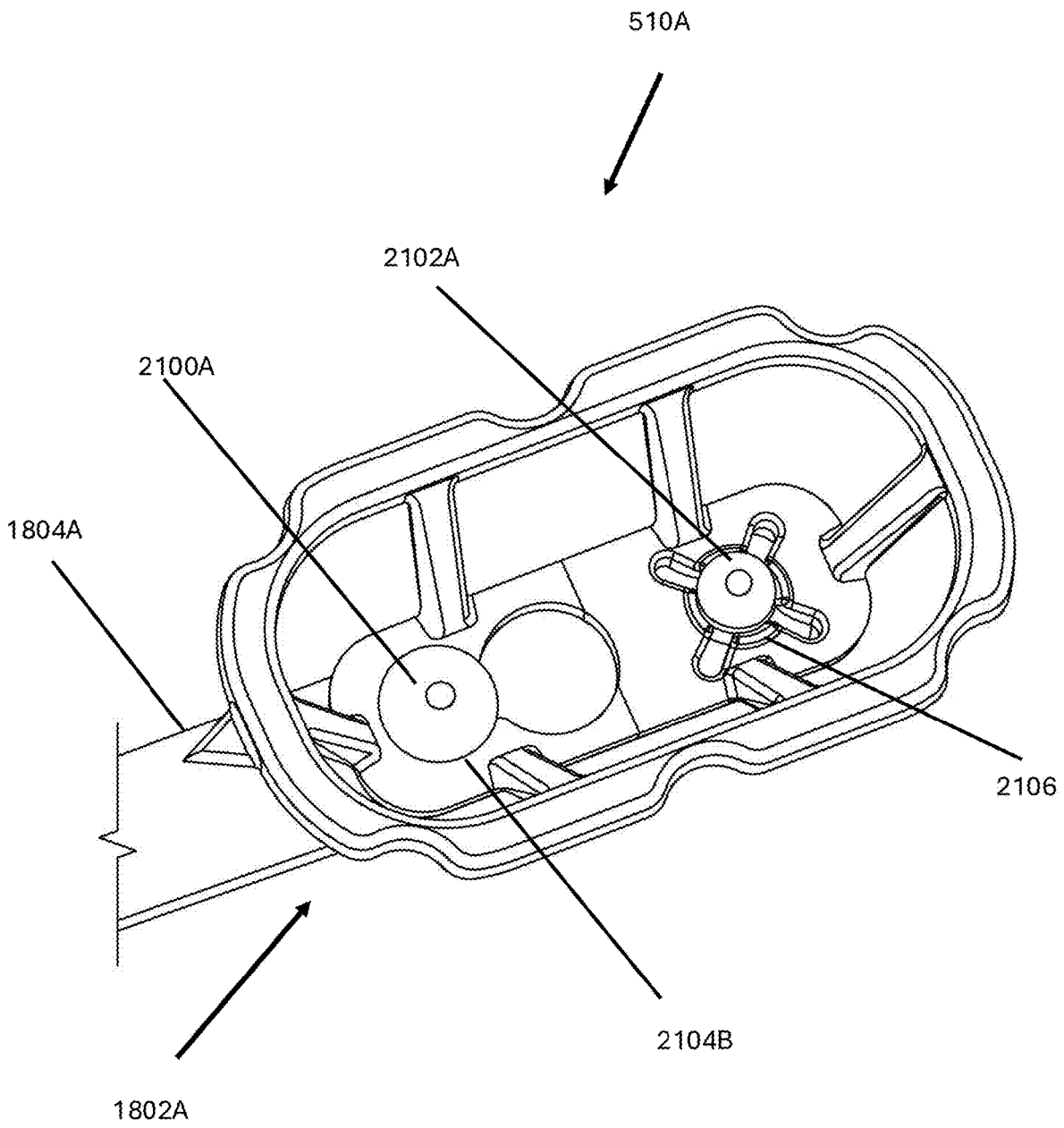

FIG. 11 discloses a plurality of padding elements of the headgear of FIG. 1;

FIG. 12 is a cutaway view of a left side of interior of the headgear of FIG. 1;

FIG. 13 is a cutaway view of a right side the interior of the headgear of FIG. 1;

FIG. 14 is a cutaway view of the right side of the interior of the headgear of FIG. 1 and presenting flow path examples extending in, through and out of the headgear of FIG. 1;

FIG. 15 is a perspective view of right side and top of the headgear of FIG. 1 and presenting flow path examples extending in, through and out of the headgear of FIG. 1;

FIG. 16 is a perspective front view of a user wearing of the headgear of FIG. 1 and in a representative example position of the user and headgear being submerged;

FIG. 17 is a perspective front view of a user wearing of the headgear of FIG. 1 and in a representative example of the user and headgear emerging from submerging by either a wave of water or a body of water;

FIG. 18 discloses additional strapping used with or within a retention system for the headgear of FIG. 1;

FIG. 19 discloses an additional strapping having double-headed mushroom pin connectors at each end, and an anchor having double-headed mushroom pin connectors used with or within a retention system of FIG. 18;

FIG. 20 discloses the anchor having one double-headed mushroom pin connector and additional components of the retention system of FIG. 19;

FIG. 21 discloses the right key-hole snap basket of FIG. 5 and a disconnected and double-headed mushroom pin connector of the retention system of FIG. 20; and FIG. 22 discloses the right double-headed mushroom pin connector of FIG. 20 and key-hole snap basket of FIG. 5 in a coupled state.

DETAILED DESCRIPTION OF THE INVENTION

In the following detailed description of the invention, numerous details, examples, and embodiments of the invention are described. However, it will be clear and apparent to one skilled in the art that the invention is not limited to the embodiments set forth and that the invention can be adapted for any of several applications. Throughout this specification, like reference numbers signify the same elements throughout the description of the Figures.

Referring now generally to the Figures and particularly to FIG. 1, FIG. 1 is a front external view of a first preferred embodiment of the present invention 100 (hereinafter "the headgear" 100). A user 101 is wearing the headgear 100 in a typical and preferred orientation upon and around the user's head 102 in FIG. 1. A user's neck 103 and user's head 102 are depicted in relation to a G-axis; the G-axis is parallel to the vector of the Earth's gravitational field, wherein in upwards is in a direction leading counter to said gravity vector and downwards is in a direction traveling towards the Earth's surface.

The headgear comprises a unitary or formed shell 104, a liner assembly 106 interposed between a padding assembly 108, and a strapping assembly 110 that comprises a right strap 110A, a left strap 110B, and a buckle clasp set 112 that in turn comprises a buckle insertion element 112A and a buckle receiving element 112B. The right strap 110A is detachably coupled with the buckle insertion element 112A and the left strap 110B is detachably coupled with the buckle receiving element 112B.

The shell 104 may be or comprise ABS a unitary Acrylonitrile Butadiene Styrene ("ABS") thermoplastic, fiberglass and/or carbon fiber or other suitable materials known in the art. The liner assembly 106 (or simply, "the liner" 106) may be or comprise Expanded Polypropylene ("EPP") a unitary or assembled shape comprising ("EPP") material, expanded polystyrene ("EPS") foam, and/or other suitable materials known in the art. The padding assembly 108 is adhered to or otherwise attached or coupled directly indirectly to the shell 104 and/or the liner 106 by suitable means known in the art. The padding assembly 108 may be or comprise Vinyl Nitrile, urethane foam, EPS foam, expanded polystyrene (EPS) foam, EPP foam and/or other suitable materials known in the art.

It is understood that in various, certain alternate preferred embodiments of the headgear 100 the liner assembly 106 may be a unitary piece that are adhered within shell 104 by suitable means known in the art. It is understood that in the present disclosure that the terms "inside", "internal", "internally" and "within" refer to a volume comprised within an inner side of the headgear 100, wherein the inner side of the headgear is the side of the headgear 100 that is proximal to the user's head 102 when the headgear is being used by the user 102. It is understood that in the present disclosure that the terms "outside", "external", "externally" side of the headgear 100 is the side or locations of the headgear 100 that are distal from the inside of the headgear 100.

It is noted that the user's head 102 of the intended user 101 comprises presents a forehead 114, and a user's brow 116. The user's brow 116 is a possibly discontinuous superciliary ridge that resides above both a right eye 118A and a left eye 118B of the intended user 101. It is understood that the term "intended user" and "intended user's head" identifies a selected range of physical variability and dimensionality of a multiplicity of users 101 hat extends beyond any single user 101.

Figure 2:
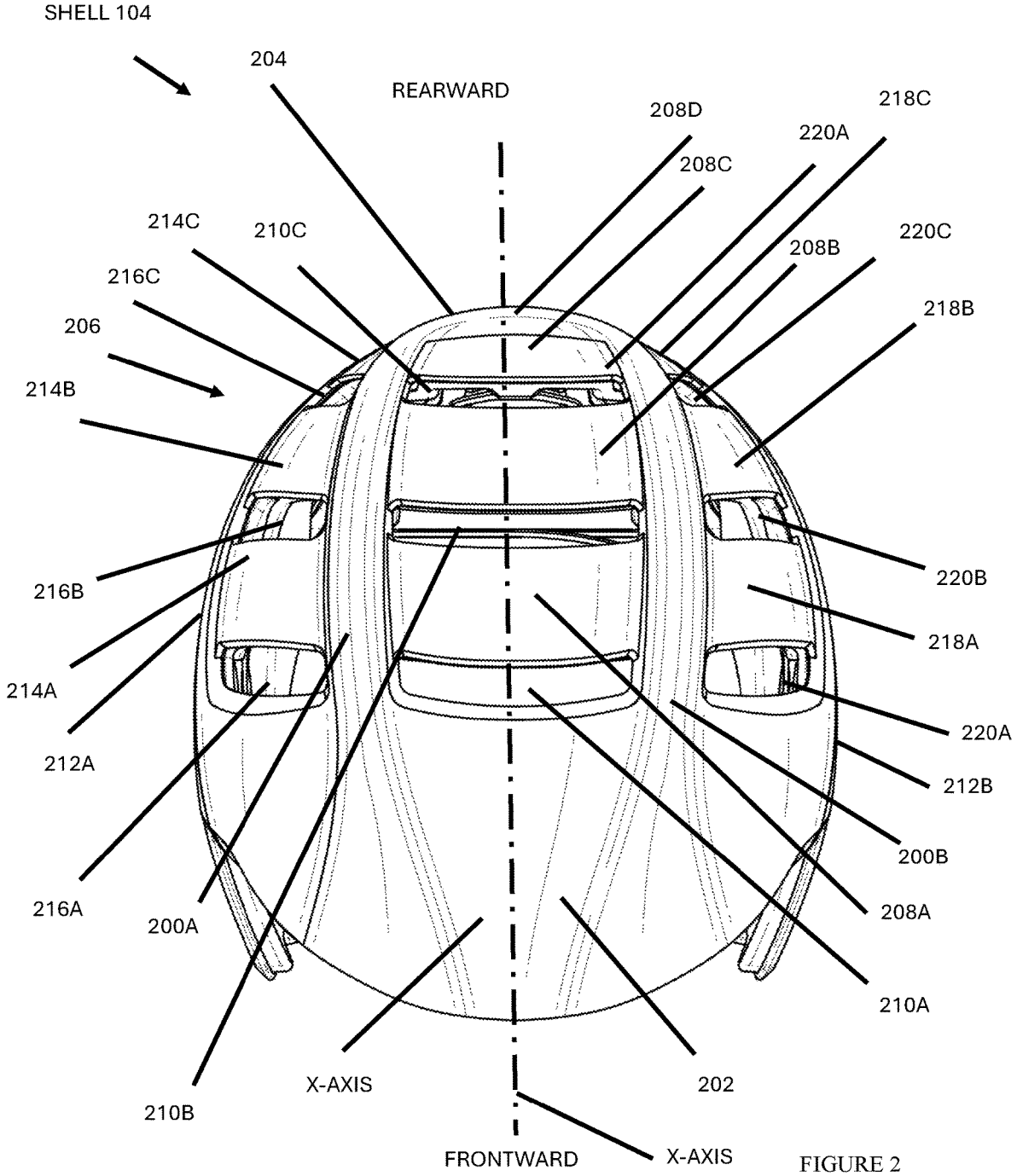
FIG. 2 is a top view of the headgear of FIG. 1.

Referring now generally to the Figures and particularly to FIG. 2, FIG. 2 is a top view of the shell 104. A longitudinal helmet axis A extends from rearward to frontward of the shell 104 and bisects the shell 104.

A right structural spine ("the right spine" 200A), a left spine 200B ("the left spine" 200B) each extend from an anterior section 202 to a posterior section 204 and in combination define an inclusive perimeter of a superior shell area 206. The superior shell area 206 further includes the four structural ribs of a first anterior rib 208A, a right medial rib 208B, a first posterior rib 208C, and a second posterior rib 208D. A longitudinal X-axis extends from rearward to frontward and substantively bisects the superior shell area 206.

The anterior section 202, the right spine 200A, and the first anterior rib 208A form and define an anterior superior vent 210A. The first anterior rib 208A, the medial rib 208B, the right spine 200A and the left spine 200B form and define a medial superior vent 210B. And the right medial rib 208B, the first posterior rib 208C, the right spine 200A and the left spine 200B form and define a posterior superior vent 210C.

A structural right medial spine 212A and a right anterior medial rib 214A in in combination with the right spine 200A and the anterior section 202 form a right anterior medial vent 216A. The right medial spine 212A and the right anterior medial rib 214A in combination with the right spine 200A and a right posterior medial rib 214B form a right medial vent 216B. The right medial spine 212A in combination with the right spine 200A, the right posterior medial rib 214B and the posterior section 204 form a right medial vent 216C. A right posterior medial rib 214C structurally couples the right spine 200A and the right medial spine 212A.

A structural left medial spine 212B and a left anterior medial rib 218A in in combination with the left spine 200B and the anterior section 202 form a left anterior medial vent 220A. The left medial spine 212B and the left anterior medial rib 218A in combination with the left spine 200B and a left posterior medial rib 218B form a left medial vent 220B. The left medial spine 212B in combination with the left spine 200A, the left medial rib 214B and the posterior section 204 form a left posterior medial vent 220C. A left posterior medial rib 218C structurally couples the right spine 200B and the right medial spine 212B.

Figure 3:
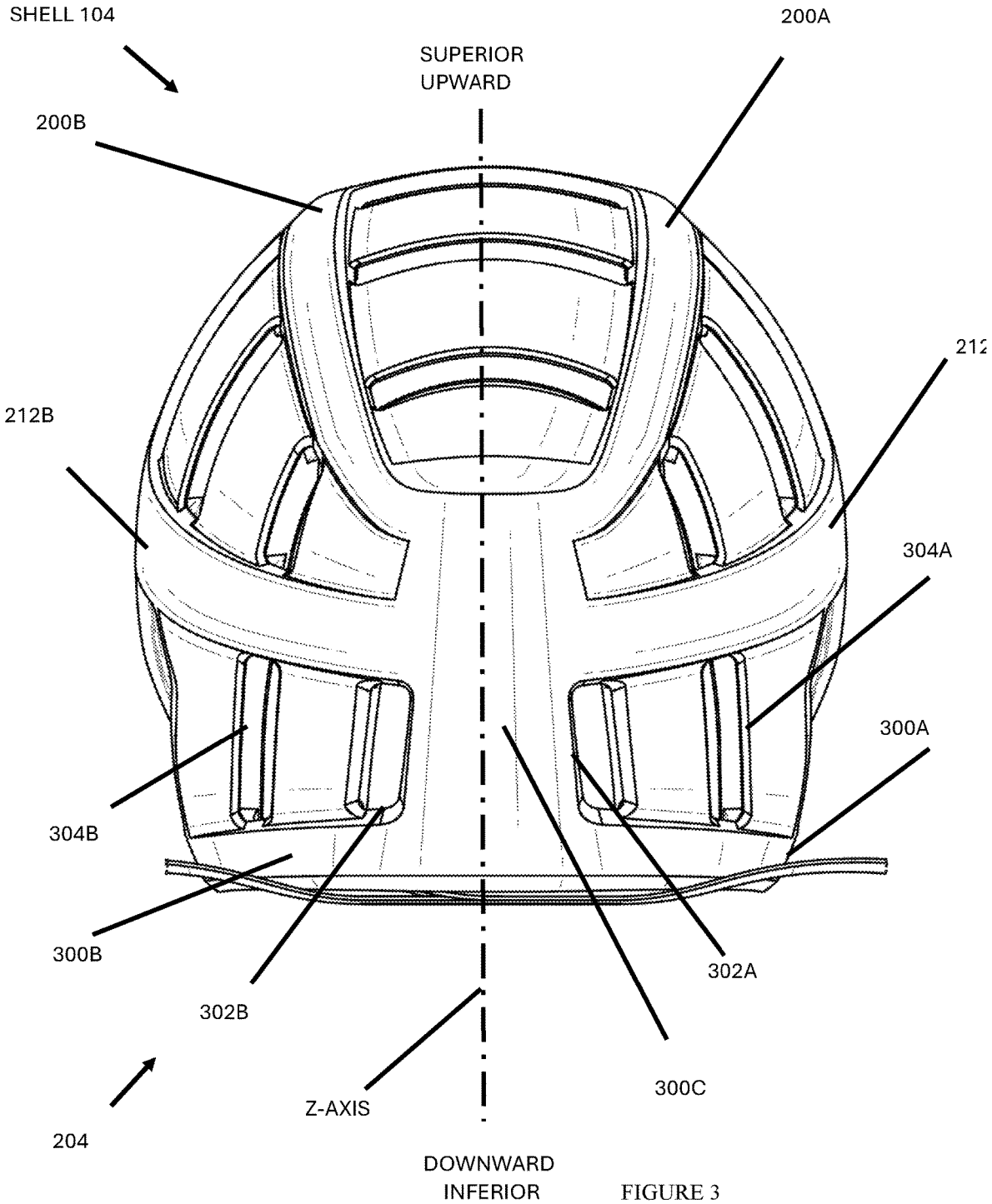
FIG. 3 is a posterior view of the headgear of FIGS. 1 and 2.

Referring now generally to the Figures and particularly to FIG. 3, FIG. 3 is a posterior view of the shell 104 is wherein a Z-axis oriented to be in parallel the gravitational G-axis extends from an inferior direction to a superior direction of the shell 104. It is understood that the headgear 100 is not rigidly positioned in relation to the gravitational G-axis, and that the headgear 100, the Z-axis, and the X-axis move controllably with movement the user, and preferably as the user 101 intends.

The rear section 204 comprises a right inferior spine 300A and a left inferior spine 300B. The rear section 204 further comprises a posterior extension 300C that extends from the right inferior spine 300A and the left inferior spine 300B. The posterior extension 300C further separately merges with the right medial spine 212A and the right spine 200A, and additionally separately merges with the left medial spine 212B and the left spine 200B. The rear section 204 further forms a right lower posterior port 302A, a left lower posterior port 302B, a second lower right port 304A, and a second lower left port 304B, through which water may flow into and out of the internal volume of the headgear 100.

Figure 4:
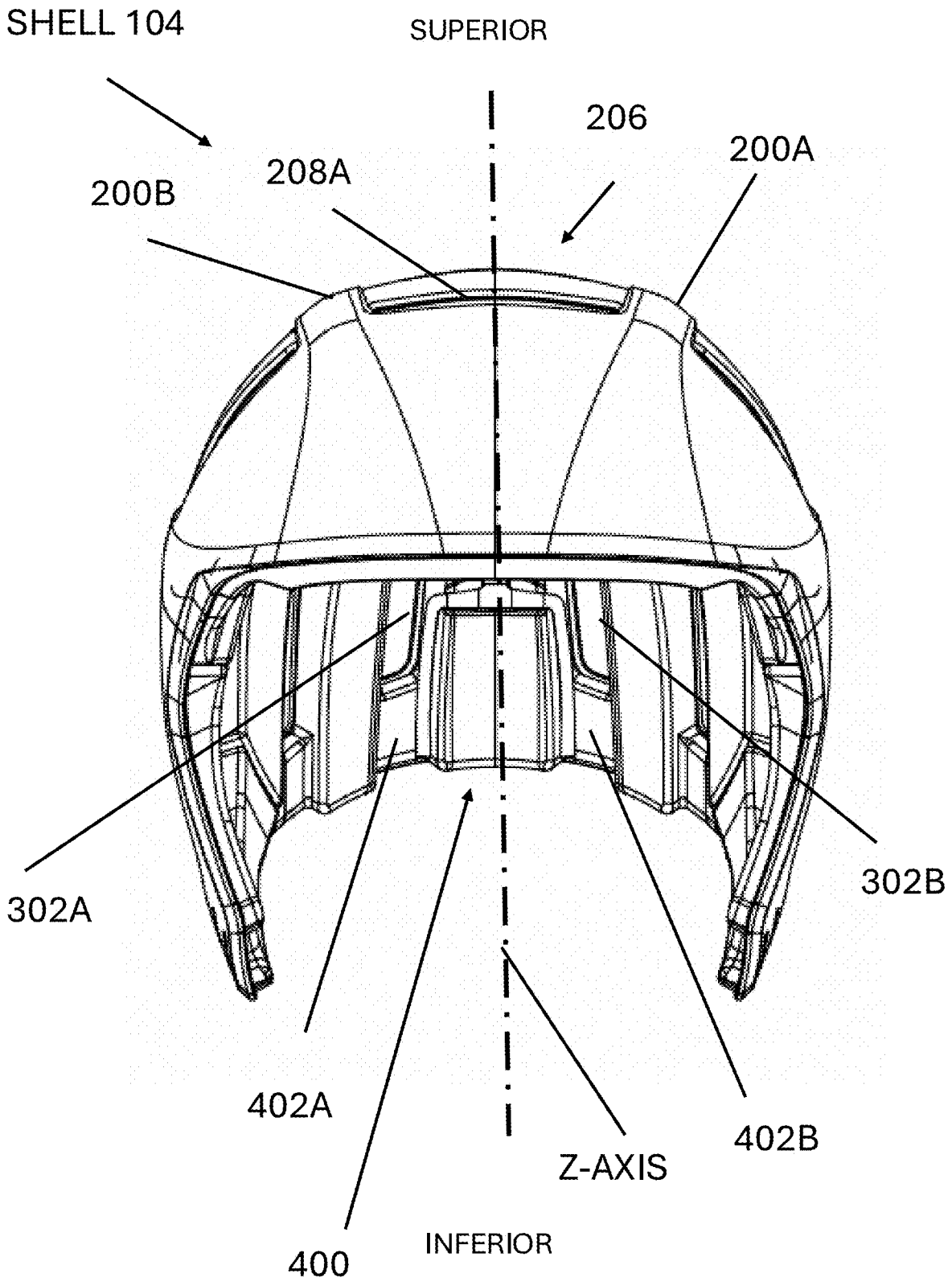
FIG. 4 is a front external view of the shell of the invented headgear of FIG. 1 and partially illustrating a rear liner element.

Referring now generally to the Figures and particularly to FIG. 2 and FIG. 4, FIG. 4 is a front view of the shell 104 respective to a Y-axis, wherein the Y-axis is parallel with the direction of the Earth's gravitational force and extends between a downward direction and an upward direction. A rear liner element 400 installed within the interior of the helmet 104 comprises and forms a right rear channel 402A and a left rear channel 402B. The right rear channel 402A and the left rear channel 402B are positioned to direct water downwards along the Y-axis to exit the headgear 102 as the user's head 102 extends upwards from a watery submersion and/or emerges from a wave of water that has flown past and previously over the user's head 102, i.e., waters entering into the headgear 102 through the superior section 206 vents 210A-210C and/or through any other vents 216A-216C, & 220A-220C of the headgear 102. The right lower posterior port 302A and the left lower posterior port 302B are presented FIG. 4 for the sake of clarity.

Referring now generally to the Figures and particularly to FIG. 5, FIG. 5 presents the shell 104 and an exploded view of a plurality of liner elements 400 & 500-504 of the shell 104, a right ear padding 506A, a left era padding 506B, a right key-hole snap basket 510A, a left key-hole snap basket 510B, a rear key-hole snap basket 510C, and a hangar bar 512. A right ear padding 506A, a left era padding 506B are adhered directly to the interior surface of the shell 104 respectively and may comprise polyurethane foam, memory EVA foam sponge, and/or other suitable materials known in the art.

The liner elements 400, & 500-504 are sized and shaped to enable snap-in friction couplings with the shell 104. The right ear pad 506R and the left ear pad 506L are sized and shaped to be adhered directly to the interior of the shell 104. The key-hole snap baskets 510A, 510B & 510C are each preferably molded within the liner 106 and separately used in combination with one double-headed mushroom pin connectors 1802A, 1802B and 1804 of FIG. 18 to support snug positioning of the shell 104 around and upon the user's head 102 as will be disclosed in FIGS. 20 through 22 and accompanying text.

Certain still alternate preferred embodiments of the method of the present invention provide that the key-hole snap baskets 510A1, 510B1 & 510C1 are each attached or adhered to the shell 104 and the liner 106 is then formed around a key-hole snap basket base 510A1, 510B1 & 510C1 so as to separately inset each key-hole snap basket 510A, 510B & 510C within and surrounded by the liner 106, wherein the liner 106 does not fill in the key-hole snap baskets 510A, 510B & 510C.

The liner 106 preferably comprises Expanded Polypropylene foam, or other suitable material known in the art, to include one or more of a plurality of liner elements 400 & 500-504. It is understood that the liner 106 may be injection molded or formed by suitable means known in the art as a single unitary piece comprising the one or more of the plurality of liner elements 400 & 500-504 that are adhered to the inside of the shell 104 in certain yet alternate preferred embodiments of the headgear 100. Alternatively, in even other alternate preferred embodiments of the present invention, one or more, or all, of the plurality of liner elements 400, 500-504, 510 & 512 may be separately formed and then adhered to, or coupled by, suitable mean known in the art to the inside of the shell 104 and/or one or more other of the plurality of liner elements 400, 500-504, 510A, 510B, 510C & 512.

Referring now generally to the Figures and particularly to FIGS. 6A through 6D, FIG. 6A is a top view of the crown liner element 504 having a front crown liner rib 600A, a second crown rib liner 600B, a third crown rib 600C, a crown liner rear section 600D, a right crown liner spine 600E and a left crown liner spine 600F.

The front crown liner rib 600A, the second crown liner rib 600B, the right crown liner spine 600E and the left crown liner spine 600F in combination form an anterior crown liner vent 600G. The anterior crown liner vent 600G is sized and shaped to not obstruct water flow through the anterior superior vent 210A of the shell 104 when the crown liner element 504 is snap fitted fitted into the shell 104.

The second crown liner rib 600B, the third crown liner rib 600C, the right crown liner spine 600E and the left crown liner spine 600F in combination form a superior crown liner vent 600H. The superior crown liner vent 600H is sized and shaped to not obstruct water flow through the medial superior vent 210B of the shell 104 when the crown liner element 504 is snap fitted into the shell 104.

The third crown liner rib 600C, the rear crown liner section 600D, the right crown liner spine 600E and the left crown liner spine 600F in combination form a posterior crown liner vent 600I. The posterior crown liner vent 600I is sized and shaped to not obstruct water flow through the posterior superior vent 210C when the crown liner element 504 is molded with, adhered to and/or snap fitted into the shell 104.

Figure 6A:
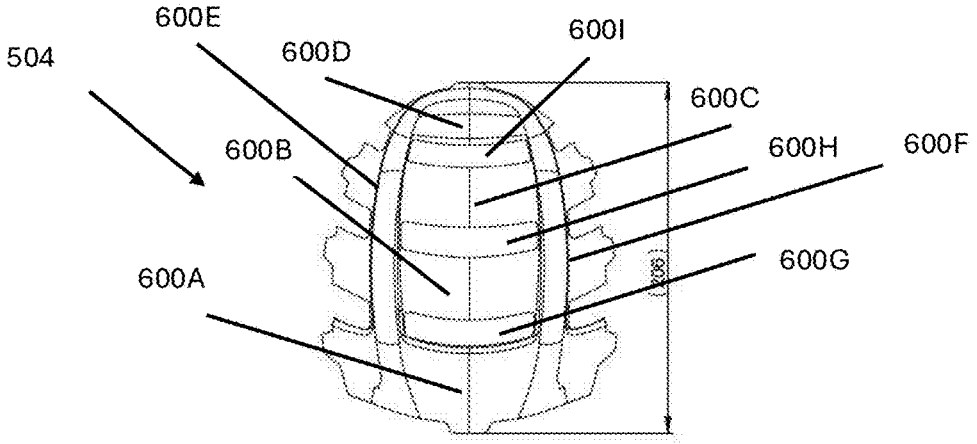
FIG. 6A is a top view of a crown liner element of FIG. 5.
Figure 6B:
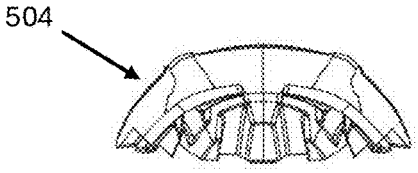
FIG. 6B is a front view of the crown liner element of FIG. 5.
Figure 6C:
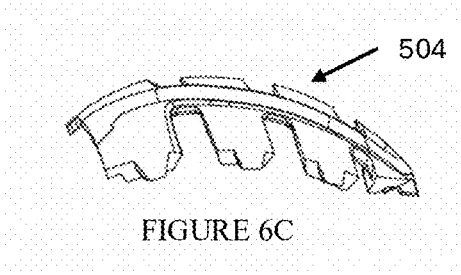
FIG. 6C is a left side view of the crown liner element of FIG. 5.

Referring now generally to the Figures and particularly to FIGS. 6B and 6C, FIG. 6B is a rear view of the crown liner element 504 and FIG. 6C is a left side view of the crown liner element 504.

Figure 6D:
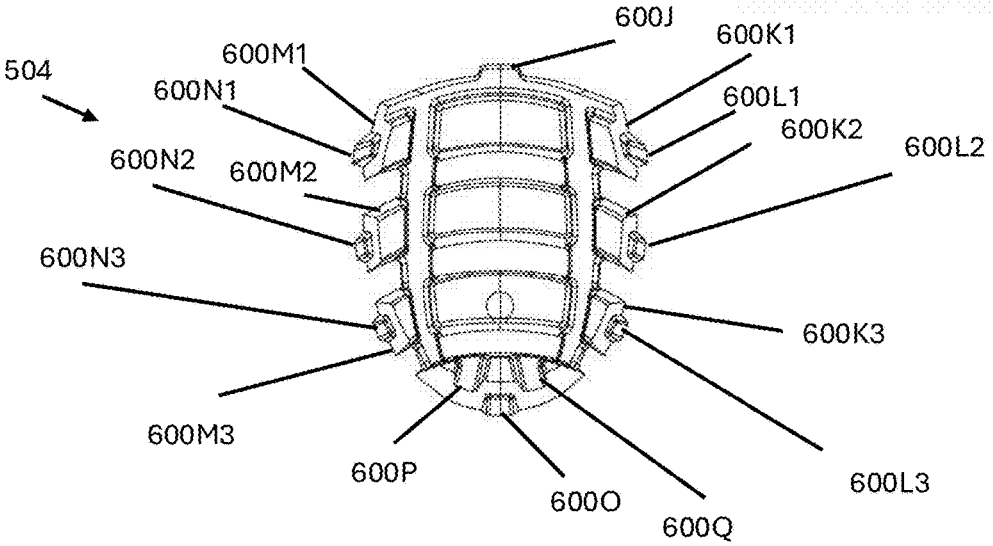
FIG. 6D is a bottom view of the crown liner element of FIG. 5.

Referring now generally to the Figures and particularly to FIG. 6D, FIG. 6D is a bottom view of the crown liner element 504. A forward extension 600J forms the forwardmost position of the crown liner element 504. A right front upper partial medial rib 600K1, right second upper partial medial rib 600K2, and a right third upper partial medial rib 600K3, and three right medial rib 600L1, 600L2 & 600L3, are each separately coupled with or attached to the right side liner element 502A to respectively form the continuous the right anterior medial rib 214A, right posterior medial rib 214B, and the third medial 214C, as disclosed in FIG. 2 and FIG. 10.

A crown rear extension 600P is side, shaped and positioned to be permanently attached to the rear liner element 400. Additionally, three left upper partial medial ribs 600M1, 600M2 & 600M3, and three left partial medial ribs 600N1, 600N2 & 600N3 are each separately coupled with or attached to the right side liner element 502A to form the continuous left medial ribs 218A, 218B & 218C, as disclosed FIG. 2 and FIG. 9.

A crown liner rearward extension 6000, a crown liner right rear extension 600P and a crown liner left rear extension are shaped, sized and positioned to be attached to or couple with the crown liner element 504 with the rear liner element 400.

Figure 7A:
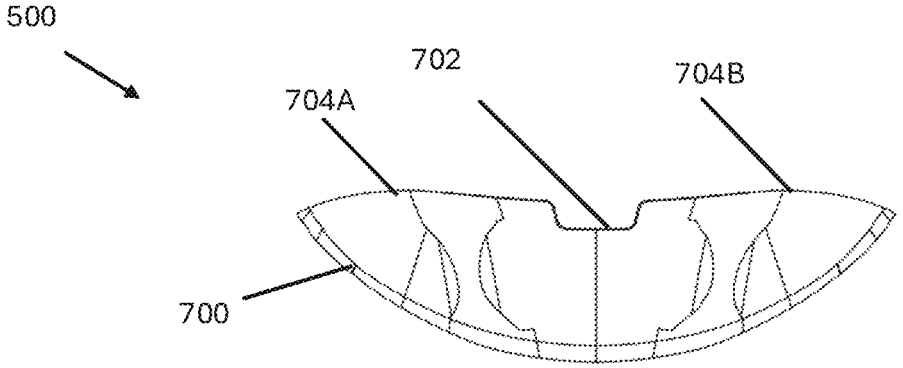
FIG. 7A is a perspective top view of a brow liner element of FIG. 5.
Figure 7B:
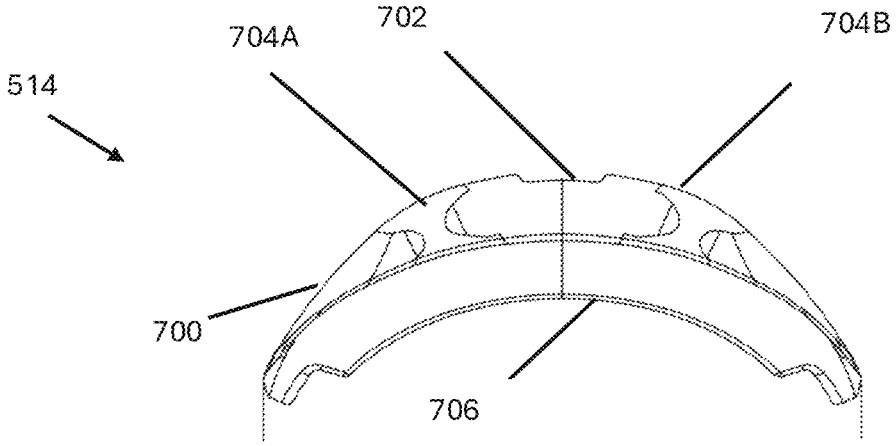
FIG. 7B is a bottom perspective front view of the brow liner element of FIG. 5.
Figure 7C:
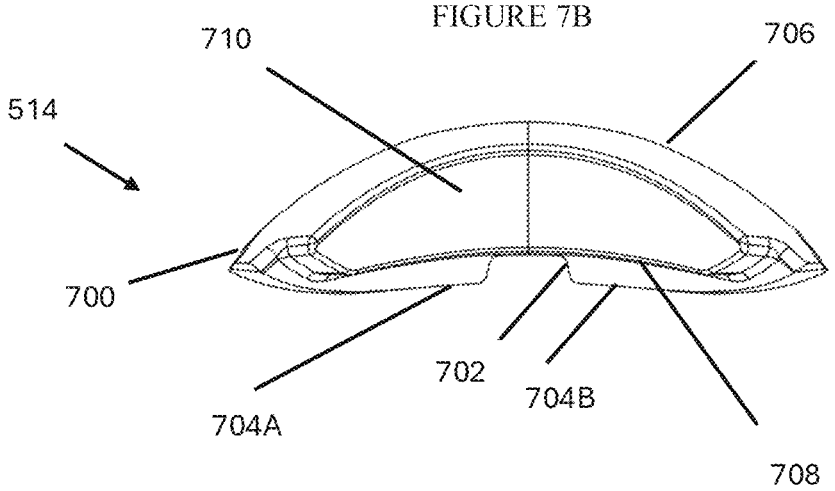
FIG. 7C is an bottom perspective back view of the brow liner element of FIG. 5.
Figure 7D:
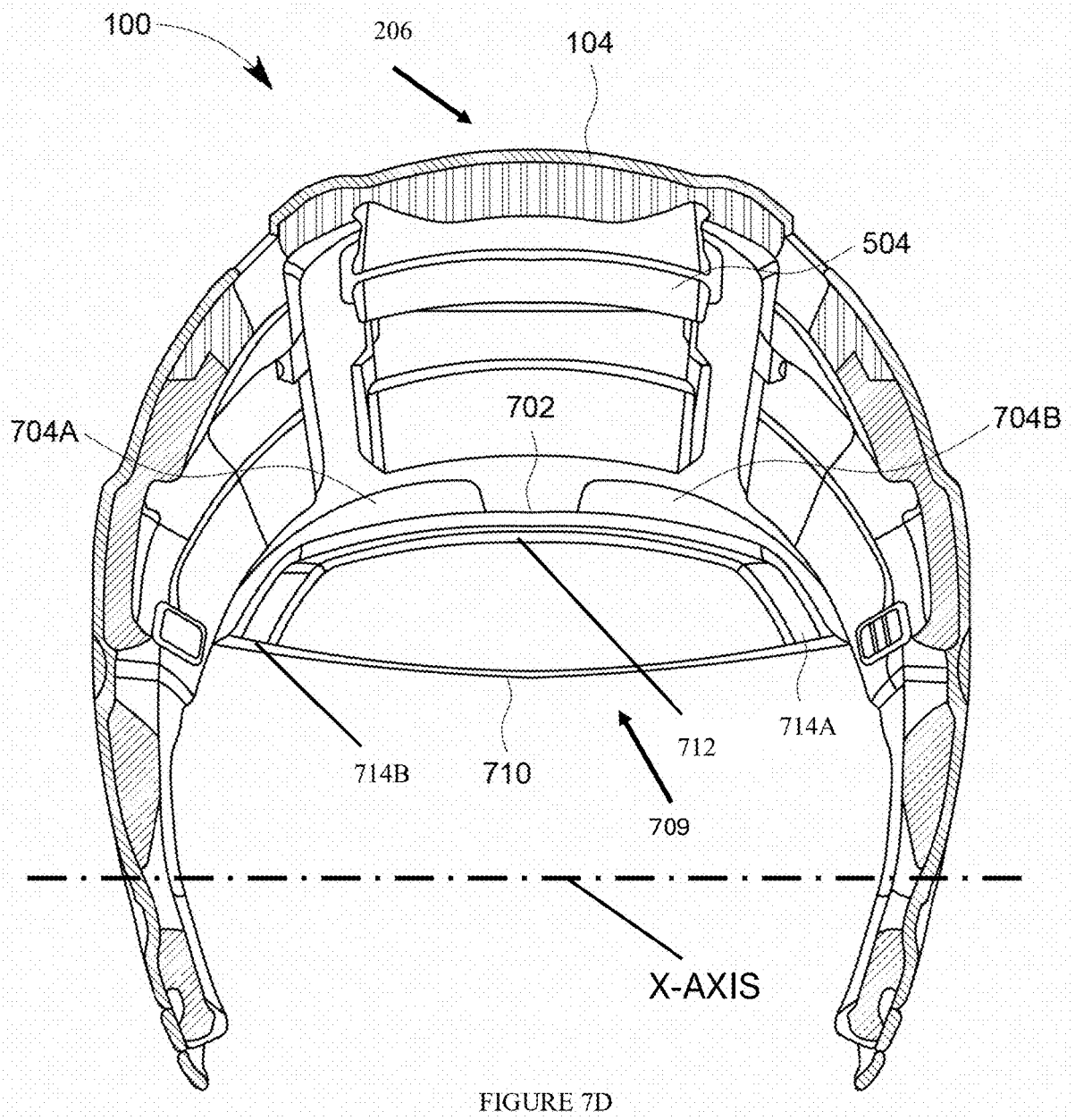
FIG. 7D is a partial cutaway back view and looking forward of the headgear of FIG. 1.

Referring now generally to the Figures and particularly to FIG. 7A and FIG. 7D, FIG. 7A is a perspective top view of a brow liner element 500. A brow liner body 700 forms a brow liner receiver 702 positioned between a brow liner right wing 704A and a brow liner leftwing 704B. The brow liner receiver 702, the brow liner right wing 704A, and the brow liner leftwing 704B are sized, shaped and positioned to enable attachment of the brow liner element 500 with the crown liner element 504.

Referring now generally to the Figures and particularly to FIG. 7B, FIG. 7B is a bottom perspective front view of the brow liner element 500 presenting a brow liner outer bottom 706. The brow liner receiver 704 is located above the brow liner outer bottom 706, as are the brow liner right wing 704A and brow liner left wing 704B.

Referring now generally to the Figures and particularly to FIG. 7C and FIG. 7D, FIG. 7C is bottom perspective back view of the brow liner element 500 of FIG. 5, wherein, with respect to FIG. 7B, (a.) the brow liner outer bottom 706 is rotated in the frontward direction, and (b.) the brow liner receiver 702, the brow liner right wing 704A, and the brow liner left wing 704B are rotated rearward. A brow user contact area 708 is shaped, sized and positioned to accept a 4 millimeter thick brow padding 710 is (as per FIG. 7D and FIG. 11) and placement proximate to a brow (not shown) of the user's head 102, whereby the brow liner element 500 is disposed between the brow padding 710 and the shell 104.

Referring now generally to the Figures and particularly to FIG. 7D, FIG. 7D is a partial cutaway back view of the headgear 100 and a liner internal side 709. The brow padding 710 is attached and disposed upon the brow user contact area 708. A water brow release channel 712 is shaped, sized and positioned to direct water away from and to either side of the brow liner outer bottom 706 and is formed by the coupling of the brow liner element 500 with the crown liner element 504. The anterior superior vent 210A is identified in FIG. 7E for the purpose of clarity of explanation.

The brow liner receiver 702, the brow liner right wing 704A, and the brow liner left wing 704B are engaged with the crown liner element 504. The brow liner element 500 and the crown liner element 504 are, in various alternate preferred embodiments of the invented headgear, molded together, permanently joined or adhered together, or alternatively detachably coupled together, and form a brow channel water release channel 712 ("the brow channel" 712). The brow channel 712 captures portions of water descending downwards within the headgear 100 and/or away from the superior section 206 and channels the received portions of water out of the helmet 100 and towards either a right brow water port 714A or a left brow water port 714B. The right brow water port 714A and the left brow water port 714B are spaced along an X-axis sufficiently distant so avoid or at least partially inhibit a release water from within the headgear 100 onto either of the eyes of an intended user 100. It is understood that he X-axis, Y-axis and the Z-axis are mutually orthogonal.

Referring now generally to the Figures, and more particularly to FIG. 1 and FIG. 7D, an internal view of an interior 709 of the liner 106 discloses the brow channel 712 as comprising a recessed internal conduit formed by the junction of the brow liner element 500 and the crown liner element 504, wherein the headgear 100 is structured to position the brow channel 712 above or upon an intended a user's brow 116 and thereby above the user's eyes 118A & 118B (as per FIG. 1). The brow channel 712 is shaped and positioned to capture water that has entered the interior of the headgear via the vents 210A-210C, 216A-216C, 220A-220C, 302A, 304B, 304A& 304B and/or ear apertures 100 & 1300, and then redirects said water, under the influence of gravity, laterally along the X-axis to exit the headgear 100 via the right brow water port 714A and the left brow water port 714B. The right brow water port 714A and the left brow water port 714B are displaced along the X-axis. These 714A & 714B ports are spaced wide enough, typically at least 3" inches to 8 inches along the X-axis, to avoid draining water directly over the user's eyes 118A & 118B of intended users 101, thereby improving visibility and wearer comfort upon by users 101 surfacing or otherwise emerging from water (not shown). The brow channel 712 operates passively using gravity and the geometry of the headgear 100, with the brow 710 at least partially pressing against the user's forehead 114 and thereby forming a barrier to downward water flow (particularly when the water is under the influence of gravity) from the interior of the headgear 100 and into or between the user's eyes 118A & 118B.

In certain additional preferred embodiments of the present invention the brow channel 712 presents right brow water port 714A and the left brow water port 714B of a width within 0.125 inches to 2.0 inches along the X-axis, and the right brow water port 714A and the left brow water port 714B are spaced apart along the X-axis within the range of 3 inches to 8 inches. It is understood that the selected spacing of the right brow water port 714A and the left brow water port 714B is largely determined by the expected size of the intended user's head 102 and forehead.

Figure 7E:
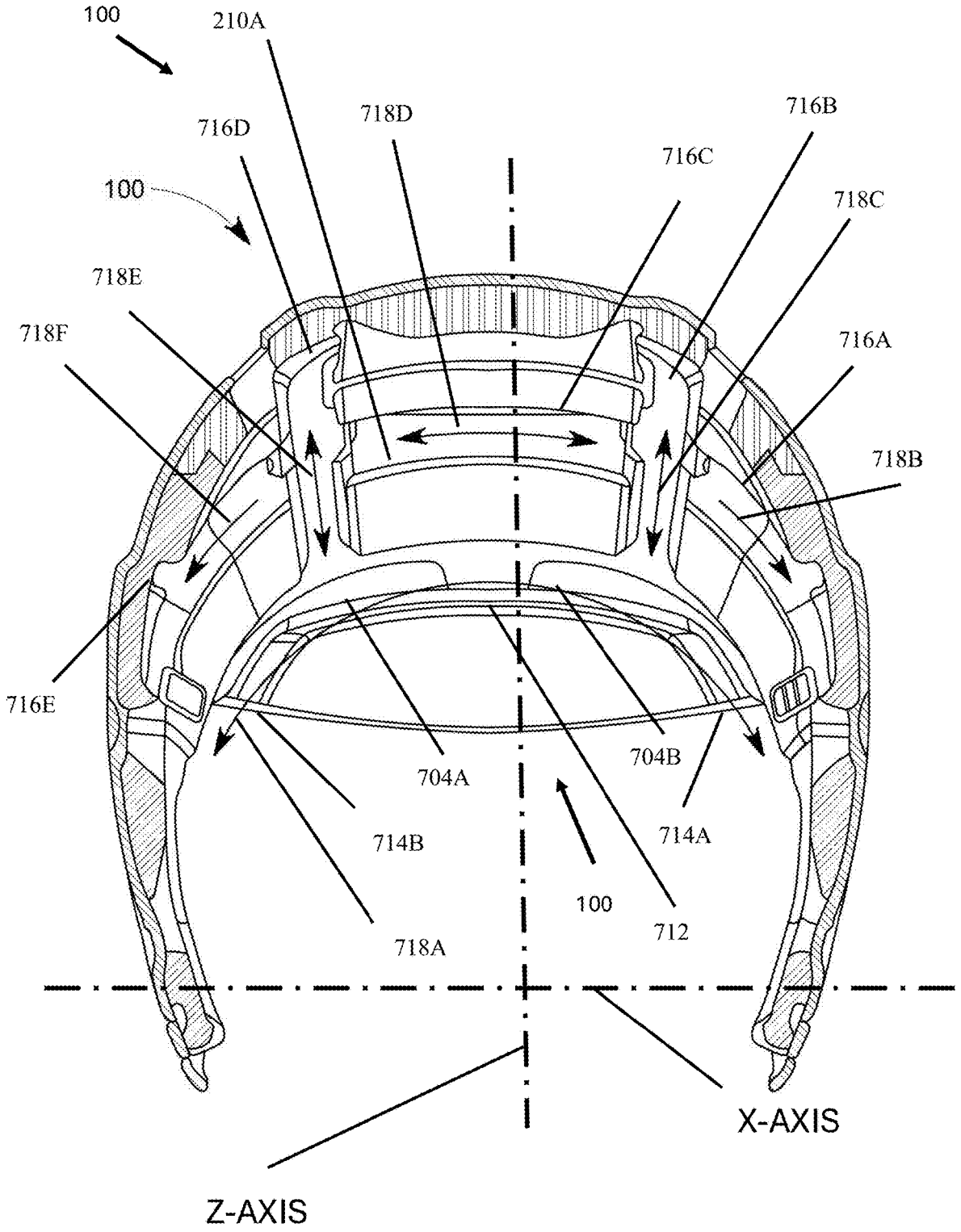
FIG. 7E is a partial cutaway back view and looking forward of the headgear of FIG. 1 and FIG. 7D, and indicating draining paths of water from the headgear of FIG. 1.

Referring now generally to the Figures and particularly to FIG. 7E, FIG. 7E is a partial cutaway back view of the headgear 100 that includes of a first plurality of internal channels 712 & 716A-716E and that separately channel at least one water flows of a first plurality of water flows 718A-718F, wherein each of the first plurality of water flow 718A-718F traverses, when under the influence of gravity, through at least one of water channel of the first plurality of internal channels 712 & 716A-7146E. The anterior superior vent 210A is identified in FIG. 7E for the purpose of clarity of explanation.

A brow water flow 718A flows through the brow channel 712 and out of the brow water port 714A and the left brow water port 714B. It is understood that the forehead user contact area 708 and brow padding 710 are each shaped, sized and positioned to at least inhibit water downwards flow out of the headgear 100 along the X-axis between the brow water port 714A and the left brow water port 714B. A first right superior water channel 716A enables a first right superior water flow 718B to flow downwards when under the influence of gravity. A right anterior water channel 716B enables a right anterior water flow 718C to flow downwards when under the influence of gravity. A central anterior water channel 716C enables a central anterior water flow 718D to flow, when under the influence of gravity, downwards and into either the first right anterior water channel 716B or a first left anterior water channel 716D. The first left anterior water channel 716D enables a first left anterior water flow 718E to flow downwards when under the influence of gravity. A first left superior water channel 716E enables a first left superior water flow 718F to flow downwards when under the influence of gravity.

Figure 8A:
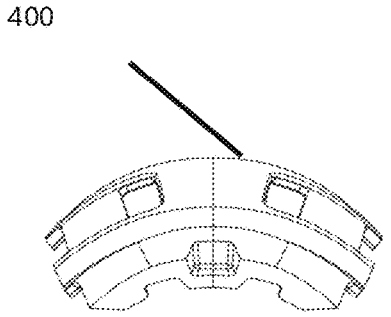
FIG. 8A is a top view of the rear liner element of FIG. 4.

Referring now generally to the Figures and particularly to FIG. 5 and FIG. 8A, FIG. 8A is a top view of the rear liner element 400.

Figure 8B:
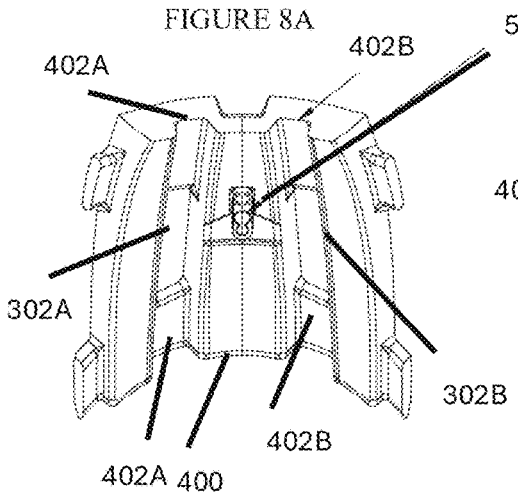
FIG. 8B is a perspective front view of the rear liner element of FIG. 4.

Referring now generally to the Figures and particularly FIG. 8B, FIG. 8B is a perspective front view of the rear liner element 400, wherein the right rear channel 402A, and the left rear channel 402B are more clearly disclosed as being discontinuous and respectively bisected by the right lower posterior port 302A and the left lower posterior port 302B.

Figure 8C:
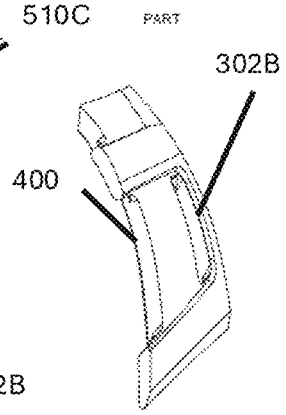
FIG. 8C is a left side view of the rear liner element of FIG. 4.

Referring now generally to the Figures and particularly FIG. 8C, FIG. 8C is a left side view of the rear liner element 400, wherein the left lower posterior port 302B is again visible.

Figure 8D:
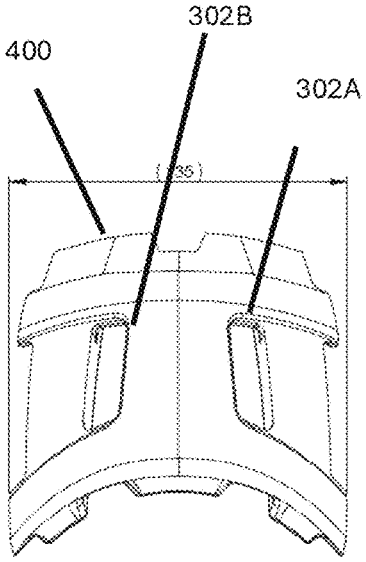
FIG. 8D is a posterior view of the rear liner element of FIG. 4.

Referring now generally to the Figures and particularly FIG. 8D, FIG. 8D is a posterior view of the rear liner element 400, wherein the right lower posterior port 302A and the left lower posterior port 302B.

Figure 8E:
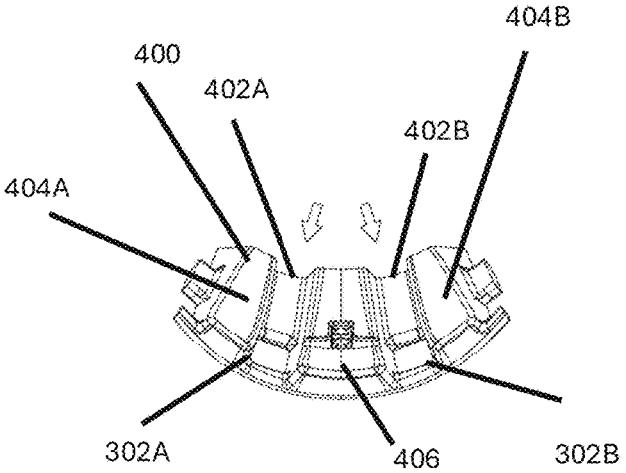
FIG. 8E is a perspective bottom view of the rear liner element of FIG. 4, and with indications of downward exit paths of water when under the influence of gravity.

Referring now generally to the Figures and particularly FIG. 8E, FIG. 8E is a perspective bottom view of the rear liner element 400 and with indications by arrows of downward exit paths of water when under the influence of gravity by means of the right rear channel 402A, and the left rear channel 402B, the right lower posterior port 302A and the left lower posterior port 302B.

Figure 9A:
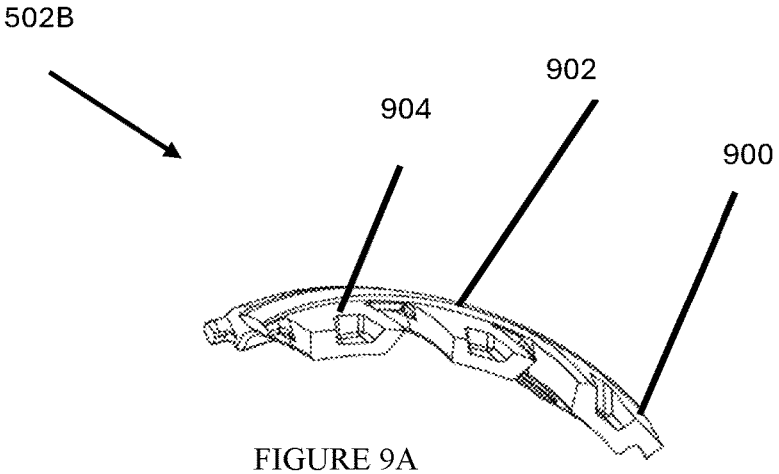
FIG. 9A is a top view of the left side liner element of FIG. 5.

Referring now generally to the Figures and particularly FIG. 9A, FIG. 9A is a top view of the left side liner element 502B. Three partial left medial ribs 900, 902 & 904, i.e., a front left partial medial rib 900, a middle left partial medial rib 902, and a third partial medial rib 904, are shaped and positioned to form the left medial ports 220A, 220B & 220C when attached to or coupled with respectively the front left upper partial medial rib 600M1, the middle left upper partial rib 600M2 and the third left upper partial medial rib 600M3, and three left medial rib extensions 600N1, 600N2 & 600N3.

Figure 9D:
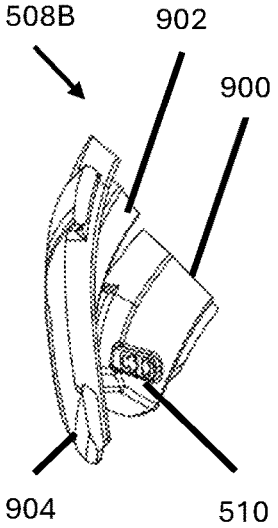
FIG. 9D is a perspective rear view of the left side liner element of FIG. 5.
Figure 9E:
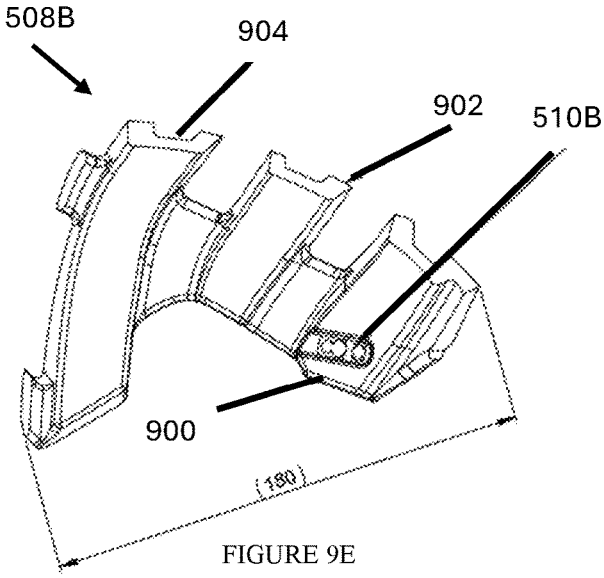
FIG. 9E is a front view of the right side liner element of FIG. 5.
Figure 9B:
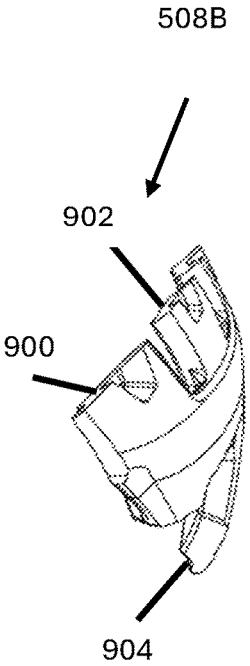
FIG. 9B is a left perspective front view of the left side liner element of FIG. 5.

Referring now generally to the Figures and particularly FIG. 9B, FIG. 9B is a left perspective front view of the left side liner element 502B and the three partial left medial ribs 900, 902 & 904.

Figure 9C:
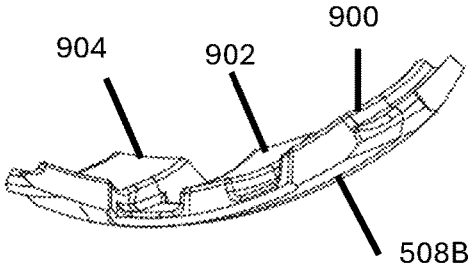
FIG. 9C is a bottom side view of the left side liner element of FIG. 5.

Referring now generally to the Figures and particularly FIG. 9C, FIG. 9C is a bottom side view of left side liner element 502B and the three partial left medial ribs 900, 902 & 904.

Referring now generally to the Figures and particularly FIG. 9D, FIG. 9D is a perspective rear view of the left side liner element 502B and the three partial left medial ribs 900, 902 & 904.

Referring now generally to the Figures and particularly FIG. 9E, FIG. 9E is a front view of the left side liner element 502B and the three partial left medial ribs 900, 902 & 904 of FIG. 6D.

Figure 10A:
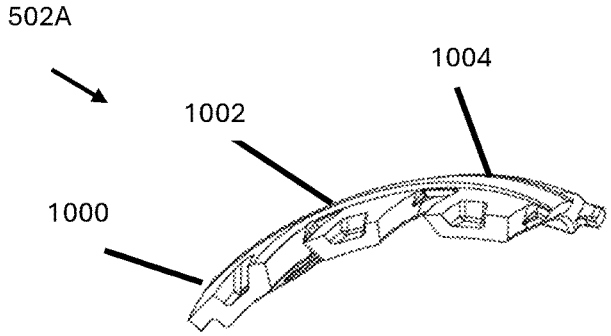
FIG. 10A is a top view of the left side liner element of FIG. 5.

Referring now generally to the Figures and particularly FIG. 1, FIG. 6D, and FIG. 10A, FIG. 10A is a top view of the right medial liner element 502A and discloses therein a right front partial medial rib 1000, a right middle partial medial part rib 1002, and a right third partial medial part rib 1004. The three right partial medial ribs 1000, 1002 & 1004 are shaped and positioned to form the right medial ports 216A, 216B & 216C when attached with or coupled with the front upper right partial medial rib 600K1, the right second upper partial medial rib 600K2 the third second upper right partial medial rib 600K3, and the three right medial rib extensions 600L1, 600L2 & 600L3 of FIG. 6D.

Figure 10D:
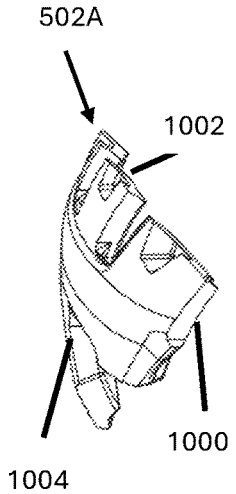
FIG. 10D is a perspective left side view of the right side liner element of FIG. 5.
Figure 10E:
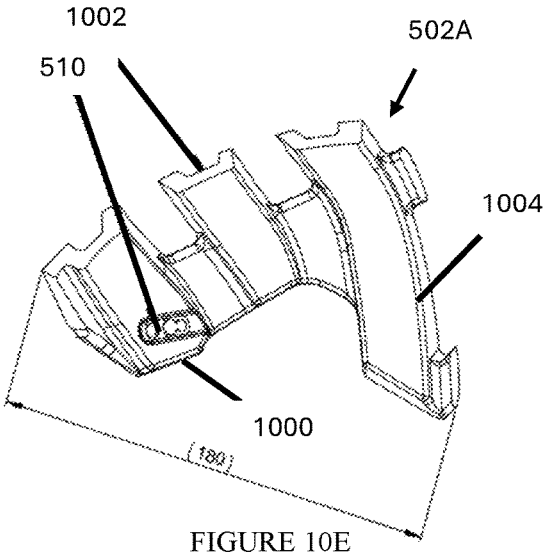
FIG. 10E is a front view of the right side liner element of FIG. 5.
Figure 10B:
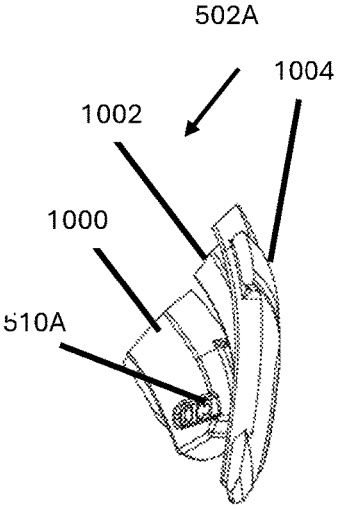
FIG. 10B is a perspective rear view of the right side liner element of FIG. 5.

Referring now generally to the Figures and particularly FIG. 10B, FIG. 10B is a perspective rear view of the right side liner element 502A and discloses right medial partial medial ribs, 1004, & 1004 and the right snap-fit 510A.

Figure 10C:
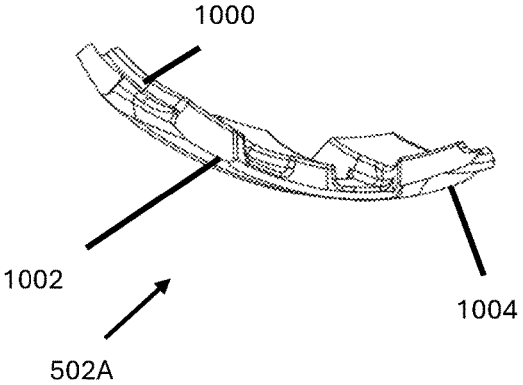
FIG. 10C is a bottom view of the right side liner element of FIG. 5.

Referring now generally to the Figures and particularly FIG. 10C, FIG. 10C is a bottom view of the right side liner element 502A and discloses right medial partial medial ribs 1000, 1002, & 1002.

Referring now generally to the Figures and particularly FIG. 10D, FIG. 10D is a perspective left side view of the right side liner element 502A and discloses right medial partial medial ribs 1000, 1002, & 1002.

Referring now generally to the Figures and particularly FIG. 10E, FIG. 10E is a front view of the right side liner element 502A and discloses right medial partial medial ribs 1002, 1004, & 1006 and the right key-hole snap basket 510A.

Referring now generally to the Figures and particularly FIG. 1 and FIG. 11, FIG. 11 discloses a plurality of padding elements 710 & 1100A-1100L. These padding elements 710 & 1100A-1100L each have a user surface as disclosed and a headgear surface, wherein the user surface of each padding element 710 & 1100A-1100L are respectively adhered to liner elements 400 & 502-506B. One more of the padding elements 710 & 1100A-1100L may be adhered directly to the liner 106 of the shell; the one more of the padding elements 710 & 1100A-1100L may comprise polyurethane foam, memory ethylene-vinyl acetate foam sponge, and/or other suitable materials known in the art.

Referring now generally to the Figures and particularly FIG. 6A and FIG. 11, a 2 millimeter thick top front padding 1100A is adhered to the front crown liner element rib 600A, whereby the front crown liner rib 600A is disposed between the top front padding 1100A and the shell 104. An additional 2 millimeter thick top middle padding 1100B is adhered to the second crown rib liner 600B whereby the second crown rib liner 600B is disposed between the top middle padding 1100B and the shell 104. Another 2 millimeter thick top rear padding 1100C is adhered to the third crown rib 600C, whereby the third crown rib liner 600C is disposed between the top rear padding 1100C and the shell 104.

Referring now to FIG. 10E, FIG. 6D, and FIG. 11, a 3 millimeter thick right side front padding 1100D is adhered to the right front partial medial rib 1000 and the upper right partial medial rib 600K1, whereby right front partial medial rib 1000 and the upper right partial medial rib 600K1 are disposed between right side front padding 1100D and the shell 104. A 3 millimeter thick right side middle padding 1100E is adhered to the to the right second partial medial rib 1002 and the right second upper partial medial rib 600K2, whereby the right second partial medial rib 1002 and the right second upper partial medial rib 600K2 are disposed between right side middle padding 1100E and the shell 104. A 3 millimeter thick right side rear padding 1100F is adhered to the right third partial medial rib 1004 and the right third upper partial medial rib 600K3, whereby the right third partial medial rib 1004 and the right third upper partial medial rib 600K3 are disposed between right side rear padding 1100F and the shell 104

Referring now generally to the Figures and particularly to FIG. 1, FIG. 6E, FIG. 9E and FIG. 11, FIG. 11 discloses a 3 millimeter thick left side front padding 1100G is adhered to both the front left partial medial rib 900 and the front upper partial medial rib 600M1, whereby the front left partial medial rib 900 and the front upper partial medial rib 600M1 are disposed between the left side front padding 1100G and the shell 104. A 3 millimeter thick left side middle padding 1100H is adhered to the middle left upper partial rib 600M2 and the the middle left partial medial rib 902, whereby the middle left upper partial rib 600M2 and the middle left partial medial rib 902 are disposed between the left side middle padding 1100H and the shell 104. A 3 millimeter thick left side rear padding 11001 is adhered to the third left upper partial medial rib 600M3 and the third left partial medial rib 902, whereby the third left upper partial medial rib 600M3 and the third left partial medial rib 902 are disposed between the left side rear padding 11001 and the shell 104.

Referring now to FIG. 1, FIG. 8E, and FIG. 11, FIG. 11 discloses a 4 millimeter thick right side rear padding 1100J is adhered to the right rear rib 404A, whereby right rear rib 404A is disposed between the right side rear padding 1100J and the shell 104. An additional 4 millimeter thick left side rear padding 1100K is adhered to the left rear rib 404B, whereby left rear rib 404B is disposed between the left side rear padding 1100K and the shell 104. Another 4 millimeter thick middle rear padding 1100L is adhered to the middle rear rib 406, whereby the middle rear rib 406 is disposed between the middle rear padding 1100L and the shell 104.

Referring now generally to the Figures and particularly FIG. 12, FIG. 12 is a cutaway side of a left side interior of the headgear 100. The rear 400, the crown liner element 504, rear liner element 400, the left side liner element 502B, the brow liner element and the left ear aperture liner element 506B are coupled and/or permanently adhered to each other, and to an interior of the shell 104. The superior vents 210A, 210B & 210C are partially represented by the crown liner element 504. The crown liner element 504 and the brow liner element 504 in combination form the brow channel 712 and the left brow water port 714B.

The left side liner element 502B and the left ear aperture liner element 506B in combination form a left ear aperture 1200. The crown liner element 504 and the left side liner element 502B in combination form the left anterior medial vent 220A and the left medial vent 220B. The crown liner element 504, the rear liner element 400 and the left side liner element 502B in combination form the left posterior medial vent 220C. The rear liner element 400 and the left side liner element 502B in combination form the second lower left port 304B. The left keyhole snap-basket 510B is preferably sunken into the left side liner element 502B.

Referring now generally to the Figures and particularly FIG. 13, FIG. 13 cutaway view of a right interior of the headgear 100. The rear 400, the crown liner element 504, rear liner element 400, the right side liner element 502A, the brow liner element 500 and the right ear aperture liner element 506A are coupled and/or permanently adhered to each other, and to an interior of the shell 104. The superior vents 210A, 210B & 210C are partially represented by the crown liner element 504. The crown liner element 504 and the brow liner element 500 in combination form the brow channel 712 and the right brow water port 714A. The right side liner element 502A and the right ear liner element 506A in combination form a right ear aperture 1300. The crown liner element 504 and the right side liner element 502A in combination form the right anterior medial vent 216A and the right medial vent 216B. The crown liner element 504, the rear liner element 400 and the right side liner element 502B in combination form the right posterior medial vent 216C. The rear liner element 400 and the right side liner element 502A in combination form the second lower right port 304A. The right key-hole snap basket 510A is sunken into the right side liner element 502A.

Referring now generally to the Figures and particularly FIG. 1 and FIG. 14, FIG. 14 is a cutaway right side of the interior of the headgear 100 and presenting exemplary flow paths 1400, 1402 & 1402 extending in, through and out of the headgear 100. A first exemplary flow path 1400 enters the headgear 100 through the anterior superior vent 210A and traverses between the user's head 102 and the headgear 100 and exits the headgear 100 through the right ear aperture 1300. A second exemplary flow path 1402 enters the headgear 100 through the medial superior vent 210B and traverses between the user's head 102 and the headgear 100 and exits the headgear 100 through the right ear aperture 1300. A third exemplary flow path 1404 enters the headgear 100 through the posterior superior vent 210C and traverses between the user's head 102 and the headgear 100 and exits the headgear 100 a bottom edge 1406 of the headgear 100.

Referring now generally to the Figures and particularly FIG. 1, FIG. 15, and FIG. 15 is a perspective view of right side and top of the headgear 100 and presenting external views exemplary flow paths 1400, 1402 & 1500 examples extending in, through and out of the headgear 100. The fourth exemplary flow path 1400 enters the headgear 100 through the anterior superior vent 210A and traverses between the user's head 102 and the headgear 100 and exits the headgear 100 through the right ear aperture 1300. The second exemplary flow path 1402 enters the headgear 100 through the medial superior vent 210B and traverses between the user's head 102 and the headgear 100 and exits the headgear 100 through the right ear aperture 1300. A fourth exemplary flow path 11500 enters the headgear 100 through the posterior superior vent 210C and traverses between the user's head 102 and the headgear 100 and exits the headgear 100 through the second lower right port 304A.

Referring now generally to the Figures and particularly FIG. 16, FIG. 16 is a perspective front view of the user 101 wearing of the headgear 100 and in a representative example of the user 101 and headgear 100 in a submerged position and possibly lying on a a surfboard (not shown), wherein the Z-axis of the headgear 100 is not parallel to the gravitational G-axis.

Referring now generally to the Figures and particularly FIG. 17, FIG. 17 is a perspective front view of a user wearing of the headgear 100 1 and in a representative example of the user 101 and headgear 100 emerging from submersion in either a wave of water (not shown) or body of water (not shown), and wherein the Z-axis of the headgear 100 is more parallel to the gravitational G-axis than as depicted in 16.

Referring now generally to the Figures and particularly FIG. 18, FIG. 18 discloses a retention strapping 1800 having a right double-headed mushroom pin connector 1802A and left double-headed mushroom pin connector 1802B separately located at each end of two retention strapping ends 1804A & 1804B, and the anchor 512 having a third double-headed mushroom pin connector 1806.

Referring now to FIG. 5 and FIG. 18, certain yet additional alternate preferred embodiments of the method of the present invention provide that the key-hole snap baskets 510A1, 510B1 & 510C1 are each attached or adhered to the shell 104 and the liner 106 is then formed around a key-hole snap basket base 510A1, 510B1 & 510C1 so as to separately inset each key-hole snap basket 510A, 510B & 510C within and surrounded by the liner 106, wherein the liner 106 does not fill in the key-hole snap baskets 510A, 510B & 510C. The liner 106 preferably positions the key-hole snap baskets top surfaces 510A2, 510B2 & 510C2 to be accessible to coupling with one double-headed mushroom pin connectors 1802A, 1802B and 1804 of FIG. 18. The key-hole snap baskets 510A, 510B & 510C and/or the double-headed mushroom pin connectors 1802A, 1802B and 1804 may comprise nylon, Acetal FIG. 5 polymer, and/or other suitable materials known in the art.

Referring now generally to the Figures and particularly FIG. 19, FIG. 19 discloses the headgear 100 and an exploded view of yet an additional retention assembly 1900 comprising the right strap 110A coupled with the buckle insertion element 112A, and the left strap 110B coupled with the buckle receiving element 112B, a right retention subassembly 1902 and a left retention subassembly 1904.

Referring now generally to the Figures and particularly FIG. 5 and FIG. 20, FIG. 20 discloses still additional elements of the retention assembly 1900 of a cinch 2000, a first strap 2002A and a second strap 2002B, and an excess strap 202C coupled with the cinch 2000. The anchor 512 having the third double-headed mushroom pin connector 1806, wherein the third double-headed mushroom pin connector 1806 is coupled with the third key-hole snap basket 512C of FIG. 5 when the headgear 100 is worn by the user 102.

Referring now generally to the Figures and particularly FIG. 5 and FIG. 21, FIG. 21 discloses the right keyhole snap basket 510A and the right double-headed mushroom pin connector 1802A in a disconnected state. The right double-headed mushroom pin connector 1802A comprises a larger mushroom pin 2100 and a smaller mushroom pin 2102. The larger mushroom pin 2100 comprises a larger mushroom head 2100A and a larger mushroom post 2100B; the smaller mushroom pin 2102 comprises a smaller mushroom head 2102A and a larger mushroom post 2102B.

As disclosed in the accompanying text of FIG. 5, certain yet other alternate preferred embodiments of the method of the present invention provide the key-hole snap baskets bases 510A1, 510B1 & 510C1 that are each attached or adhered to the shell 104 and the liner 106 is then formed around the key-hole snap baskets 510A, 510B & 510C so as to separately anchor each key-hole snap basket 510A, 510B & 510C the liner 106, wherein the liner 106 does not fill in the key-hole snap baskets 510A, 510B & 510C and yet positions the key-hole snap baskets top surfaces 510A2, 510B2 & 510C2 to be flush with the liner interior 709 as disclosed in FIG. 7D and accompanying text. One or more volumes of material silicone may be placed within the key-hole snap basket 510A, 510B & 510C inhibit the EPP foam contacting more then the bases, wherein the material x may then be removed from the key-hole snap baskets 510A, 510B & 510C after the EPP foam has cured.

A keyhole aperture 2104 of the right key-hole snap basket 510A comprises a first aperture 2104A communicatively formed with an adjoining aperture 2104B. The first aperture 2104A is sized and shaped to accept insertion of a larger mushroom head 2100A of the right double-headed mushroom pin connector 1802A. The adjoining aperture 2104B of the keyhole aperture 2104 is sized to accept movement of the larger mushroom post 2100B along a direction moving along the X'-axis and away from the first aperture 2104A while the larger mushroom head 2100A is inserted into the right keyhole snap basket 510A. The adjoining aperture 2104B is also sized and shaped to inhibit a removal of the larger mushroom head 2100A in a direction away from contact with the right key-hole snap basket 510A.

A second receiver 2106 of the right keyhole snap basket 510A is sized and shaped to deform to accept insertion of the smaller mushroom head 2102A of the right double-headed mushroom connector 1802A and the second receiver 2106 thereupon resists or prohibits removal of the smaller mushroom post 2102B from the right keyhole snap basket 510A.

The smaller mushroom post 2102B and the larger mushroom post 2100A are spaced along the X'-axis to cause the first end 1804A to lay flat against the right key-hole snap basket 510A when the right double-headed mushroom pin connector 1802A and the right key-hole snap basket 510A are coupled, as disclosed in FIG. 22.

Referring now generally to the Figures and particularly FIG. 21 and FIG. 22, FIG. 22 discloses the right double-headed mushroom pin connector 1802A and the right key-hole snap basket 510A in a coupled state. The larger mushroom head 2100A is inserted through the adjoining aperture 2104B, and the smaller mushroom head 2102A is inserted through the second receiver 2106.

It is understood that the shapes, usage, and dynamics of the right key-hole snap basket 510A and the right double-headed mushroom pin connector 1802A as disclosed above apply to the shapes, usage, and dynamics of the left double-headed mushroom pin connector 1802B and the right key-hole snap basket 510B, It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims. Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the range's limits, an excluding of either or both of those included limits is also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

When elements are referred to as being "connected" or "coupled," the elements can be directly connected or coupled together or one or more intervening elements may also be present. In contrast, when elements are referred to as being "directly connected" or "directly coupled," there are no intervening elements present.

While selected embodiments have been chosen to illustrate the invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment, it is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

We claim:

1. A surf helmet, comprising:

an outer shell, the outer shell having an interior side, an exterior side, and a superior section, and the outer shell forming a plurality of shell ports, the plurality of shell ports comprising:

at least two superior elongate water ports extending fully through the outer shell and laterally both through the superior section of the outer shell and across a length axis of the surf helmet, the length axis extending from a posterior side of the surf helmet to an anterior side of the surf helmet when worn by a user;

at least two right side elongate water ports, each right side elongate water port extending downwards along a right side of the surf helmet when worn by the user;

at least two left side elongate water ports, each left side elongate water port extending downwards along a left side of the surf helmet when worn by the user; and an inner structural core, comprising:

a plurality of interior channels formed in combination with the interior side, wherein each interior channel of the plurality of interior channels extends downward from at least one shell port of the plurality of shell ports; and a plurality of dedicated core openings, each dedicated core opening enabling egress from one shell port of the plurality of shell ports, whereby water is enabled to transit from the outer shell interior side and beyond the outer shell exterior side.

2. The surf helmet of claim 1, wherein the inner structural core inhibits water from flowing from within the surf helmet and over a user's eyes when the user's head is emerging from a submersion in water.

3. The surf helmet of claim 2, wherein the inner structural core further comprises an inner structural core anterior section extending to a front inner rim of the outer shell and positioned onto the interior surface of an outer shell anterior section, wherein the surf helmet at least partially inhibits water flow from within the surf helmet to over a user's face when the surf helmet is worn.

4. The surf helmet of claim 3, wherein the anterior section of the inner structural core is coextensive with the interior surface of the outer shell anterior section.

5. The surf helmet of claim 1, further comprising a bottom edge of the surf helmet, the bottom edge positioned distally from the superior section of the surf helmet and, wherein the plurality of interior channels directs water flow and air flow from within the surf helmet and away from a user's eyes when the user's head has emerged from a submersion in water and the section is positioned above the bottom edge.

6. The surf helmet of claim 1, further comprising at least one longitudinal channel that directs water and air within the helmet toward the posterior side of the surf helmet and into at least one interior channel of the plurality of interior channels.

7. The surf helmet of claim 1, further comprising at least one longitudinal channel that directs water toward the posterior side of the surf helmet from a first interior channel of the plurality of interior channels and into a second interior channel of the plurality of interior channels.

8. The surf helmet of claim 1, further comprising at least one longitudinal channel that directs water from a first interior channel of the plurality of interior channels and out of at least one shell port of the plurality of shell ports.

9. The surf helmet of claim 1, further comprising a comfort liner disposed on an inner structural core interior side, wherein the comfort liner is positioned distally from the outer shell and the comfort liner allows unobstructed function of the plurality of interior channels, and the comfort liner enhances user comfort and moisture management.

10. The surf helmet of claim 1, further comprising the outer shell further comprising at least one right posterior elongate water port, the at least one right posterior elongate water port extending downwards and toward a bottom edge of the surf helmet;

the inner structural core further comprising an additional matching right posterior core opening, whereby the at least one right posterior elongate water port and the additional matching right posterior core opening in combination enable water to pass through the outer shell.

11. The surf helmet of claim 10, the plurality of interior channels further comprising a right posterior channel that extends from the additional matching right posterior core opening to a bottom of the helmet.

12. The surf helmet of claim 1, further comprising the outer shell further comprising at least one left posterior elongate water port, the at least one left posterior elongate water port extending downwards and toward a bottom edge of the surf helmet; and the inner structural core further comprising an additional matching left posterior core opening, whereby the at least one left posterior elongate water port and the additional matching left posterior core opening in combination enable water to pass through the outer shell.

13. The surf helmet of claim 12, the plurality of interior channels further comprising a left posterior channel that extends from the additional matching left posterior core opening to a bottom of the helmet.

14. The surf helmet of claim 1, wherein the inner structural core comprises a plurality of core parts, each core part formed prior to installation onto the interior surface of the outer shell.

15. The surf helmet of claim 1, further comprising a retention system, wherein the retention system comprises:

a key-hole element, the key-hole element presenting a first mushroom pin and a second mushroom pin, the second mushroom pin having a larger head than a smaller head of the first mushroom pin;

a first strap anchored to an inside of the outer shell at a first strap end and comprising a second strap end coupled with a key-hole snap basket, the key-hole snap basket having a first aperture sized to accept an insertion of the second mushroom's head, and a smaller second aperture sized to inhibit a withdrawal of the second mushroom's head; and the key-hole basket further comprising a forward second slot, the forward second slot (i.) deformable to accept an insertion of the first mushroom pin's smaller head, (ii.) being elastic to inhibit withdrawal of the first mushroom pin's smaller head, and (iii.) shaped to obstruct insertion of the second mushroom pin's large head, whereby when the first mushroom pin extends through the second slot and the second mushroom pin extends through the second aperture, the key-hole snap basket inhibits the second mushroom pin sliding forward to and exiting from the first aperture and thereby decoupling the first strap from the key-hole snap basket.

16. The surf helmet of claim 15, wherein the retention system comprises at least one laterally positioned adjustable chin strap assembly extending downwards from the outer shell.

17. A surf helmet, comprising:

an outer shell, comprising:

at least two superior elongate water ports extending laterally through a portion of superior section of the outer shell and downwards from a length axis of the surf helmet upper edges extending below the length axis, the length axis extending from a posterior side of the surf helmet to an anterior side of the surf helmet;

a frontal extension that extends forward and downward from the superior section, the frontal extension providing enhanced protection to a wearer's forehead and brow and deflecting oncoming water, and limiting direct water dumping onto the wearer's face is prevented, thereby reducing visual obstruction during and after wave impact; and an inner structural core extending up from at least two superior elongate water ports, and the inner structural core forming a right channel extending from a right end of at least one superior water port and toward a bottom of the surf helmet, and the inner structural core forming a left channel extending from a left end of at least one superior water port and toward the bottom of the surf helmet.

18. The surf helmet of claim 17, wherein the frontal extension is contoured to channel water laterally into the integrated channel and vent system to further improve fluid evacuation and user visibility.

19. The surf helmet of claim 17, the inner structural core further comprising an inner structural core anterior section extending to a front inner rim of the outer shell and positioned onto the interior surface of an outer shell anterior section, wherein the surf helmet at least partially inhibits water flow from within the surf helmet to over a user's face when the surf helmet is worn.

20. The surf helmet of claim 17, wherein inner structural core further forms a recessed channel located behind a brow region of the inner structural core, the recessed channel configured to capture and redirect water away from the wearer's face during submersion or wave impact, thereby enhancing visibility and user comfort.

21. The surf helmet of claim 17, wherein the inner structural core extends beyond a standard protective test line defined by whitewater helmet safety standards, thereby providing enhanced cranial coverage during impact.

* * * * *